US007490827B2

(12) United States Patent
Miki et al.

(10) Patent No.: US 7,490,827 B2
(45) Date of Patent: Feb. 17, 2009

(54) IMAGE FORMING APPARATUS

(75) Inventors: Katsuhiko Miki, Tokyo (JP); Osamu Takehira, Kanagawa (JP); Yuko Hayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 414 days.

(21) Appl. No.: 11/475,077

(22) Filed: Jun. 27, 2006

(65) Prior Publication Data

US 2007/0002117 A1 Jan. 4, 2007

(30) Foreign Application Priority Data

Jun. 30, 2005 (JP) ..... 2005-193216

(51) Int. Cl.
*B65H 3/06* (2006.01)

(52) U.S. Cl. ..... 271/117; 271/118

(58) Field of Classification Search ..... 271/117, 271/118

See application file for complete search history.

(56) References Cited

U.S. PATENT DOCUMENTS

| | | | | |
|---|---|---|---|---|
| 4,395,032 | A * | 7/1983 | Hipp, Jr. | 271/10.01 |
| 6,585,253 | B1 | 7/2003 | Miki | |
| 6,601,843 | B2 | 8/2003 | Miki | |
| 6,631,899 | B2 | 10/2003 | Miki | |
| 6,948,710 | B2 | 9/2005 | Togashi et al. | |
| 6,997,453 | B2 | 2/2006 | Matsuda et al. | |
| 2003/0132568 | A1 * | 7/2003 | Garcia et al. | 271/38 |
| 2004/0046310 | A1 | 3/2004 | Miki | |
| 2004/0070136 | A1 * | 4/2004 | Chung | 271/117 |
| 2004/0207145 | A1 * | 10/2004 | Chang | 271/117 |
| 2004/0245704 | A1 * | 12/2004 | Hall et al. | 271/117 |
| 2005/0023745 | A1 * | 2/2005 | Morimoto et al. | 271/117 |
| 2005/0194733 | A1 * | 9/2005 | Asada | 271/117 |
| 2005/0196211 | A1 | 9/2005 | Miki | |
| 2005/0285328 | A1 * | 12/2005 | Rumford et al. | 271/118 |

FOREIGN PATENT DOCUMENTS

| | | |
|---|---|---|
| EP | 1 302 421 A2 | 4/2003 |
| JP | 8-26506 | 1/1996 |
| JP | 2974911 | 9/1999 |
| JP | 2000-95355 | 4/2000 |
| JP | 2002-68505 | 3/2002 |
| JP | 2002-154694 | 5/2002 |
| JP | 2003-155129 | 5/2003 |

* cited by examiner

*Primary Examiner*—David H Bollinger
(74) *Attorney, Agent, or Firm*—Oblon, Spivak, McClelland, Maier & Neustadt, P.C.

(57) ABSTRACT

A sheet conveying apparatus, an automatic draft conveying apparatus, a paper feeding apparatus, and an image forming apparatus capable of preventing self-oscillation of a conveying roller. When rigidity of an oscillation system of the conveying roller is K [N/m], the distance between a supporting point of an arm and a section of the arm to which an axis of the conveying roller is attached is L [mm], and arm angle, which is formed between a sheet and a line segment connecting the supporting point of the arm to the section of the arm to which the axis of the conveying roller is attached on an assumed plane perpendicular to a direction of the axis of the conveying roller, is θ [deg], $\theta \leqq (Pse \times K^{-0.5}) \times (1/L)$ is satisfied, where Pse=37500.

18 Claims, 25 Drawing Sheets

IMAGE FORMING APPARATUS

BACKGROUND OF THE INVENTION

1. Field of the Invention

The present invention relates to an image forming apparatus such as a facsimile machine, printer, and copying machine, and particularly to a sheet conveying apparatus capable of preventing self-oscillation of a conveying roller.

2. Description of the Background Art

As disclosed in Japanese Patent Application No. 2974911 and Japanese Patent Application Laid-Open No. H9-25017, for example, in an image forming apparatus such as a facsimile machine, printer, and copying machine, there has been conventionally used a sheet conveying apparatus which is installed in a place for conveying a set sheet of script to a reader or a place for conveying a sheet of paper stored on a paper feed tray to an image forming section. Further, the sheet conveying apparatus is installed in not only these places but also a place for conveying a sheet discharged to a catch tray to a predetermined location.

Such a sheet conveying apparatus is constituted from a pickup roller which functions as a conveying roller for conveying a sheet, an arm in which the pickup roller is attached rotatably to one end thereof and a spring is attached to the other end thereof, and a sheet supporting plate which faces the pickup roller with a sheet therebetween. The arm is attached rotatably to an axis extending from the apparatus main body, and the pickup roller is capable of oscillating in a top-to-bottom direction. Furthermore, the pickup roller is brought into contact with a sheet by the spring at a predetermined pressure. When conveying a sheet which is set on the sheet conveying apparatus, the pickup roller rotates in a sheet conveyance direction and, with this rotation, the sheet is conveyed in a paper feed direction by frictional force between the pickup roller and the sheet.

However, in the prior art, there was a problem that, when the number of sheets set on the sheet conveying apparatus decreases after being conveyed, delay of sheet conveyance occurs. Particularly, when the number of set sheets decreases below twenty, the pickup roller oscillates by itself, and the contact pressure between the pickup roller and the sheet is reduced. As a result, the frictional force between the pickup roller and the sheet also decreases and the pickup roller slips on the sheet. As a result, it was discovered that the distance of conveyance performed by the pickup roller decreases, causing delay of sheet conveyance.

Technologies relating to the present invention are also disclosed in, e.g., Japanese Patent Application Laid-Open No. 2002-068505 and Japanese Patent Application Laid-Open No. 2003-155129.

SUMMARY OF THE INVENTION

The present invention is contrived in view of the above problems, and an object thereof is to provide a sheet conveying apparatus capable of preventing self-oscillation of a conveying roller, an automatic draft conveying apparatus, a paper feeding apparatus, and an image forming apparatus which comprise this sheet conveying apparatus.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Before explaining the present invention, the conventional technology and problems described above are explained with reference to the drawings.

Figure 1:
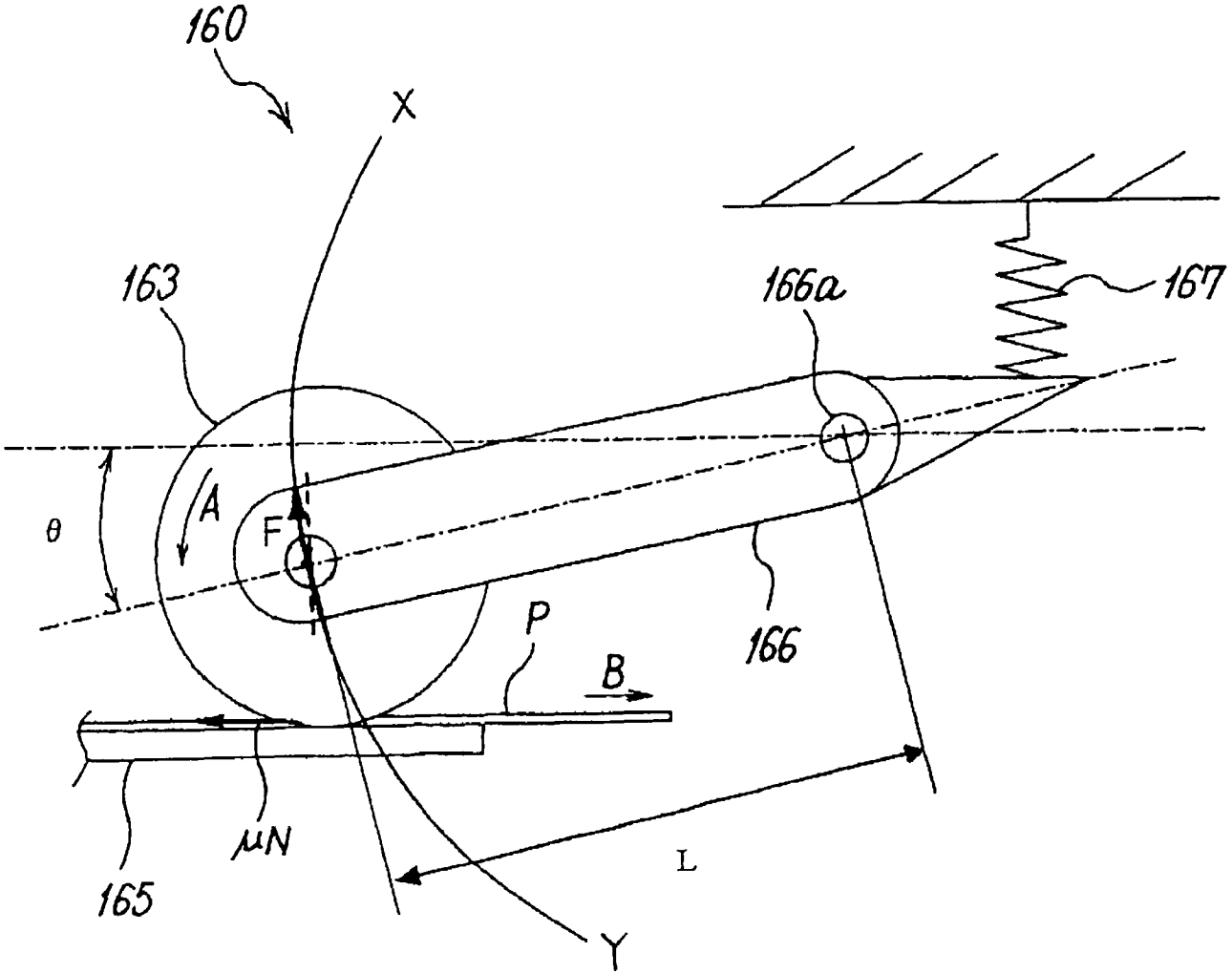
FIG. 1 is a figure showing a schematic configuration of an example of a conventional sheet conveying apparatus.

FIG. 1 shows an example of a configuration of a sheet conveying apparatus which is used in a conventionally known image forming apparatus. As shown in the figure, this sheet conveying apparatus 160 comprises a pickup roller 163 which functions as a conveying roller rotating by means of driving force generated from an unshown driving force and for conveying a sheet, and an arm 166 in which the pickup roller 163 is attached rotatably to one end thereof and a spring 167 is attached to the other end thereof. The sheet conveying apparatus 160 further comprises a sheet supporting plate 165 which faces the pickup roller 163 with a sheet therebetween. The arm 166 is attached rotatably to an axis 166*a* extending from the apparatus main body, and the pickup roller 163 is capable of oscillating in a top-to-bottom direction in the figure. Furthermore, the pickup roller 163 is brought into contact with a sheet by the spring 167 at a predetermined pressure.

When conveying a sheet which is set on this sheet conveying apparatus 160, the driving force generated from the unshown driving source rotates the pickup roller 163 in a direction shown with the arrow A in the figure. The surface of the pickup roller 163 has a high coefficient of friction and contacts with the sheet at the predetermined pressure, thus, with the rotation of the pickup roller 163, a sheet P is conveyed in a conveyance direction B by frictional force between the pickup roller 163 and the sheet P.

However, as described above, there was a problem that, when the number of sheets set on the sheet conveying apparatus 160 decreases after being conveyed, delay of sheet conveyance occurs.

Figure 2:
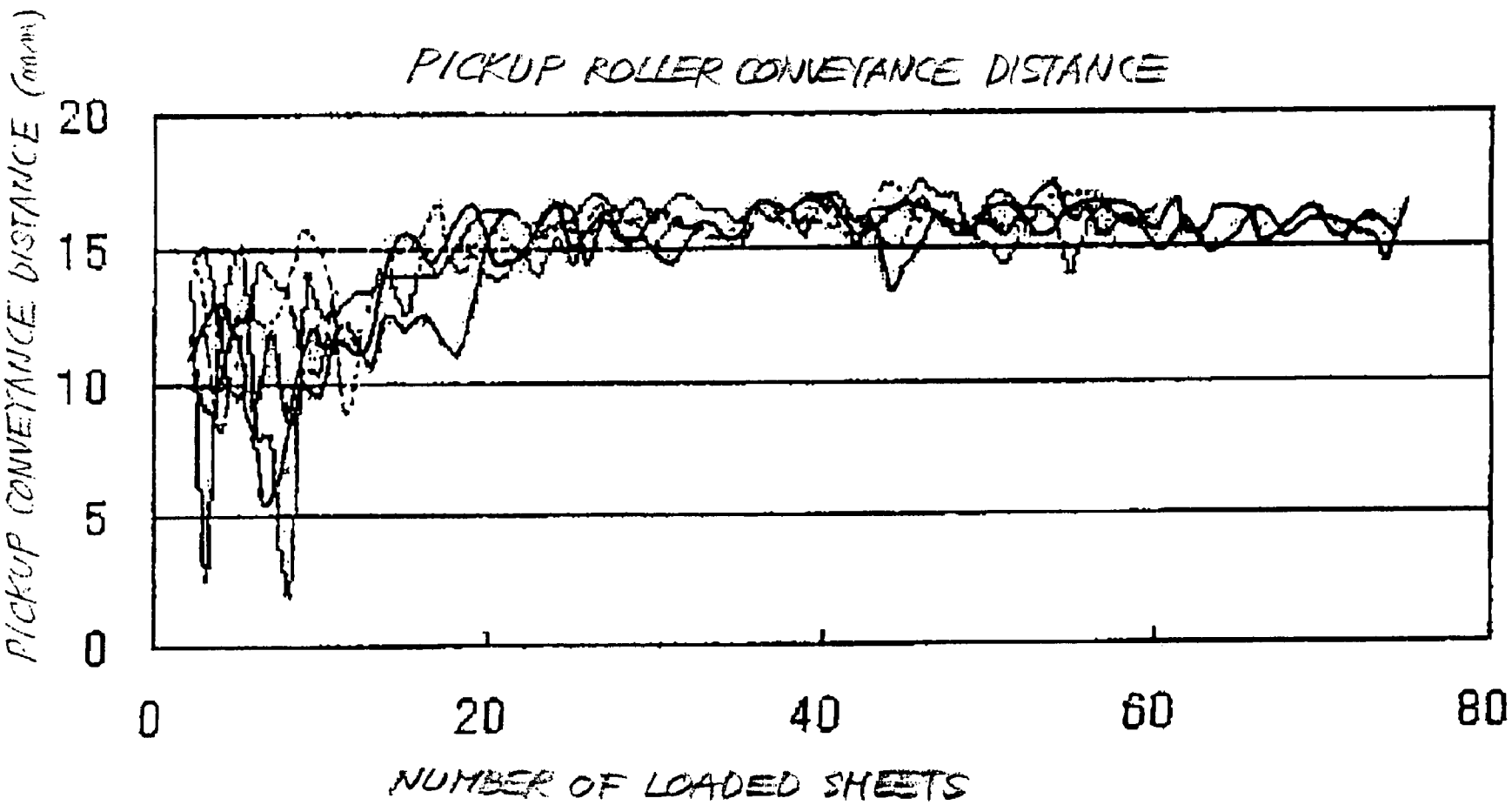
FIG. 2 is a graph showing the relationship between the number of loaded recording sheets inside a recording sheet storage section in the conventional sheet conveying apparatus and a pickup conveyance distance.

FIG. 2 is a graph showing the relationship between the number of set sheets and moving distance of the top sheet (referred to as "pickup conveyance distance" herein after) of the sheets which are set on the sheet conveying apparatus 160 when the top sheet is conveyed by the pickup roller 163 for a predetermined period of time. As shown in this figure, it can be seen that, when the number of sheets set on the sheet conveying apparatus 160 decreases below twenty, the pickup conveyance distance is reduced. In this case, as described above, when the number of sheet decreases below twenty, the pickup roller 163 oscillates by itself, and the contact pressure between the pickup roller 163 and the sheet is reduced. As a result, the frictional force between the pickup roller 163 and the sheet decreases and the pickup roller 163 slips on the sheet. Accordingly, the pickup conveyance distance decreases, causing delay of sheet conveyance. These phenomena were discovered by the three inventors of the present invention in the keen experiments.

The following is an explanation of the results of the keen experiments performed by the inventors of the present invention to investigate the cause of self-oscillation of the conveying roller.

In the sheet conveying apparatus 160 comprising the configuration shown in FIG. 1, the arm length L [mm], the rigidity K [N/m] of an oscillation system of the conveying roller, the inertia moment I [kg/m$^2$], and the arm angle θ [deg] were applied with different values respectively to investigate whether self-oscillation of the conveying roller was generated or not.

It should be noted that the oscillation system of the conveying roller means a constructional element which is a factor of the self-oscillation of the conveying roller. In other words, the conveying roller (pickup roller) 163 is the arm 166, spring 167, and sheet supporting plate 165. Furthermore, the arm angle θ is 0° when a line segment, which is obtained by connecting a sheet, a supporting point of the arm, and a section for attaching the conveying roller to the arm on an assumed plane perpendicular to a direction of an axis of the arm, is parallel to the sheet, and when the supporting point of the arm is positioned closer to an upstream side in a sheet conveyance direction than the axis attachment section of the conveying roller.

Figure 3:
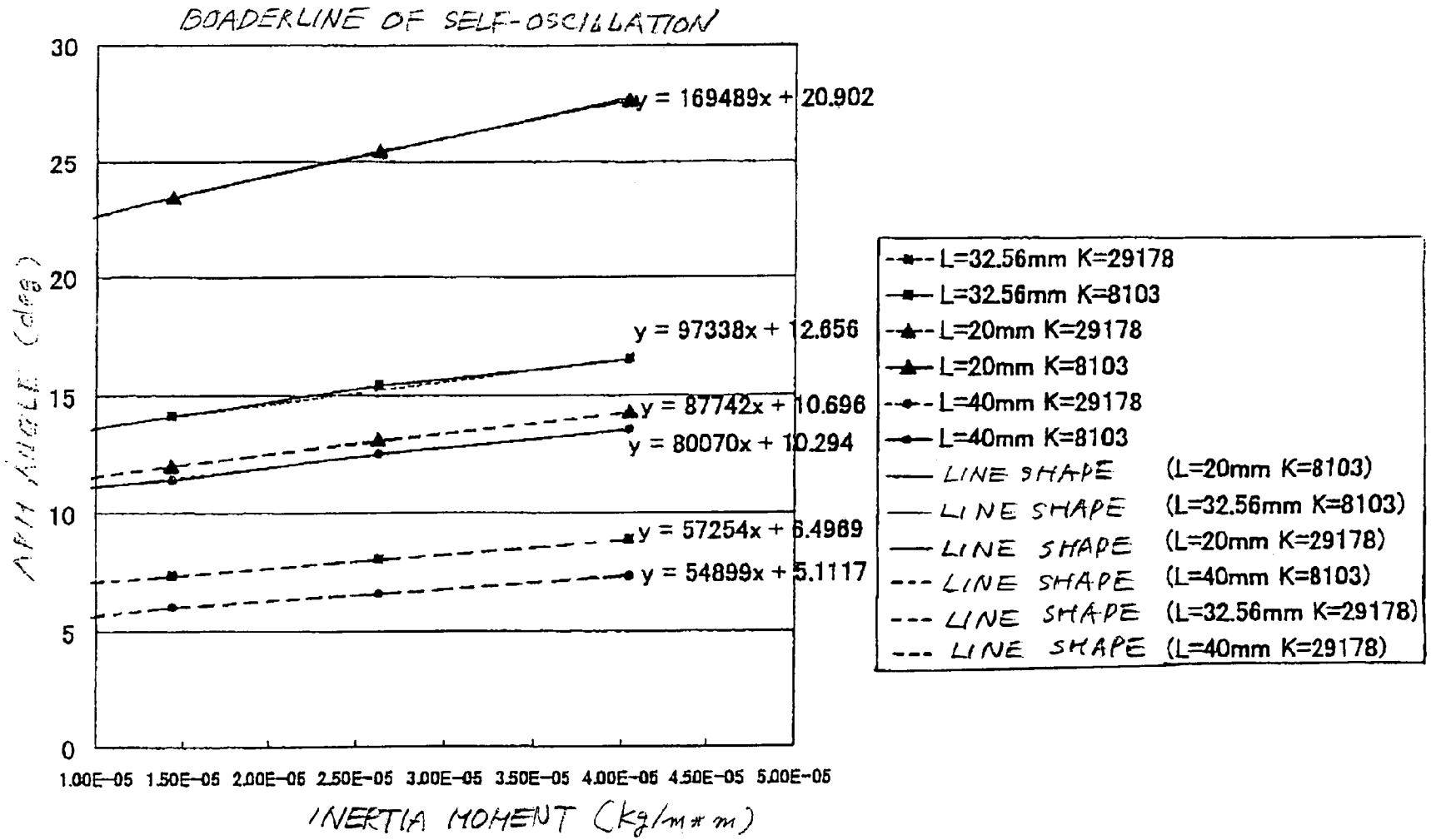
FIG. 3 is a figure showing the relationship between arm angle θ and inertia moment I in the sheet conveying apparatus.

FIG. 3 shows a summary of the investigation results. The line segment shown in the figure indicates a borderline indicating the occurrence of self-oscillation of the roller. As shown in the figure, regardless of the arm length L and the magnitude of the rigidity K of the oscillation system, the borderline indicating the occurrence of self-oscillation, which is represented by the relationship between the arm angle θ and the inertia moment I, can be expressed by a primary expression showing the line shapes as shown in the following equation (1).

$$\theta = A \times I + B \qquad \text{Equation (1)}$$

It should be noted the A and B shown in this equation (1) are numerals determined by the relationship between the rigidity K of the oscillation system of the conveying roller and the arm length L. Also, if at least the arm angle θ is equal to or less than the value on the right side of the equation (1), self-oscillation of the conveying roller does not occur. Here, as shown in FIG. 3, it can be seen that the upper limit of the arm angle θ, at which self-oscillation does not occur, increases if the inertia moment I increases. Accordingly, by setting the arm angle θ to a value which is equal to or lower than the upper limit of the arm angle at which self-oscillation does not occur when the inertia moment is 0, the occurrence of self-oscillation can be prevented at any value of the inertia moment. Specifically, the arm angle θ is set to a value which is equal to or lower than B in the equation (1).

Figure 4:
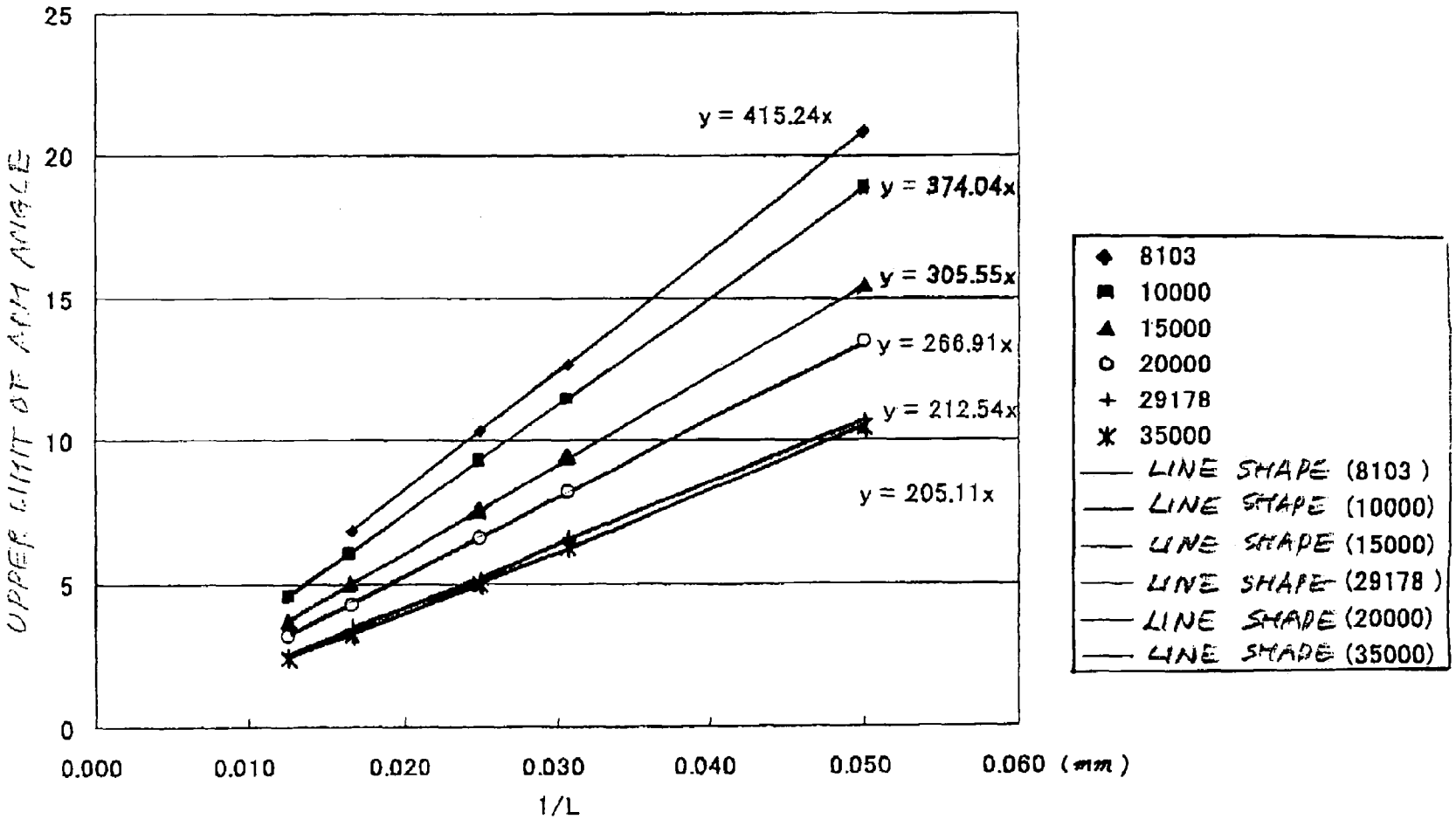
FIG. 4 is a figure showing the relationship between the arm angle θ and arm length.

The value of B shown in the above equation (1) changes when the arm length L and the rigidity K of the oscillation system of the conveying roller change, as shown in FIG. 3. Therefore, the inventors of the present invention investigated the relationship among the upper limit $\theta_{MAX}$ of the arm angle (B in the equation (1)) at which self-oscillation does not occur when the inertia moment is 0, the arm length L, and the rigidity K of the oscillation system of the conveying roller. The results of this investigation are shown in FIG. 4. As shown in FIG. 4, the borderline indicating the occurrence of self-oscillation, which is represented by the relationship between the upper limit $\theta_{MAX}$ of the arm angle and inverse of the arm length L (1/L) regardless of the magnitude of the rigidity K of the oscillation system of the conveying roller, can be expressed by a primary expression showing the line shapes as shown in the following equation (2).

$$\theta_{MAX}=C\times(1/L) \quad \text{Equation (2)}$$

Figure 5:
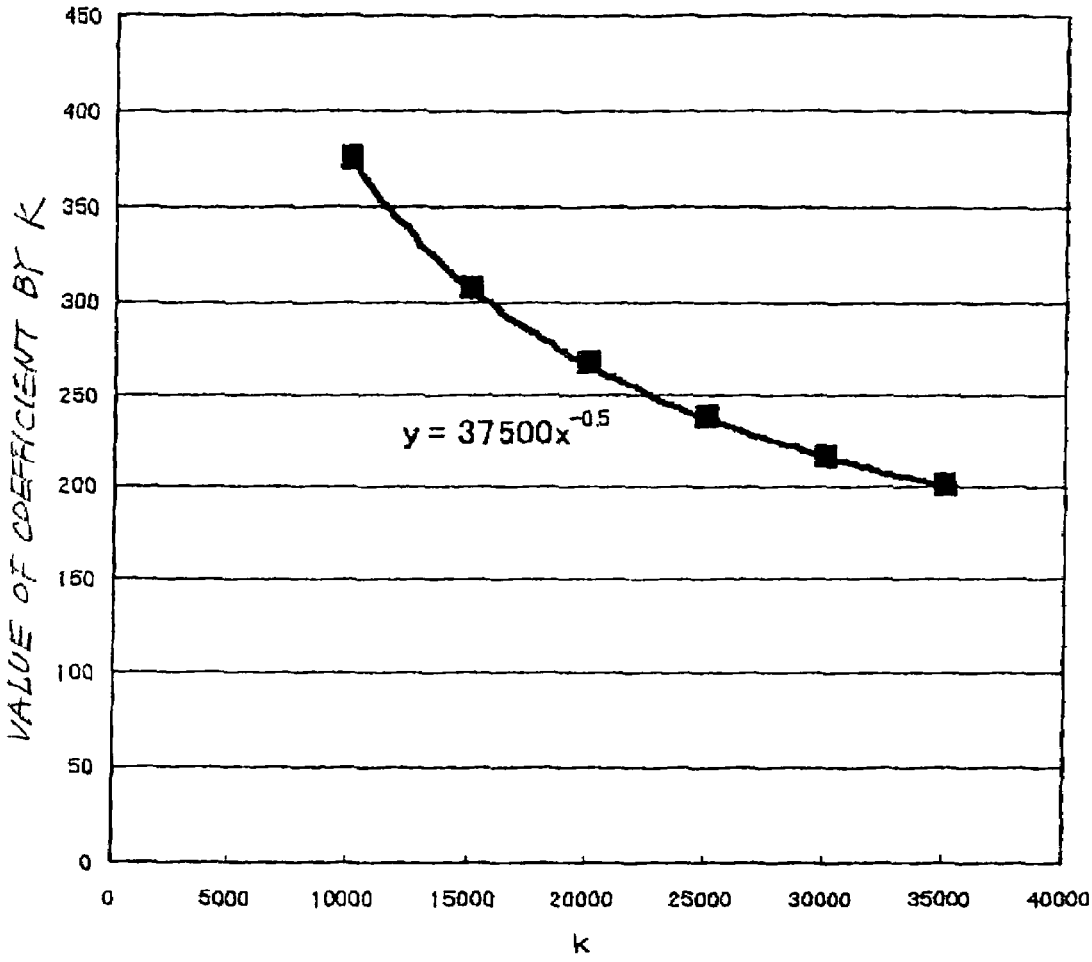
FIG. 5 is a figure showing the relationship between inclination C and rigidity K.

If at least the arm angle θ is equal to or less than the value on the right side of the equation (2), self-oscillation of the conveying roller does not occur. It can be seen from FIG. 4 that an inclination C of the borderline indicating the occurrence of self-oscillation changes for every rigidity K, the borderline being represented by the relationship between the upper limit $\theta_{MAX}$ of the arm angle and the inverse of the arm length L (1/L). Therefore, when investigating the relationship between the inclination C and the rigidity K, the relationship shown in FIG. 5 was obtained. When approximating the inclination C with the rigidity K with this curved line, it is found the relationship expressed by the following equation (3) is obtained.

$$C=Pse\times K^{-0.5}$$

$$Pse=37500 \quad \text{Equation (3)}$$

By substituting the equation (3) into the equation (2), the borderline indicating the occurrence of self-oscillation can be expressed by the relationship among the upper limit $\theta_{MAX}$ of the arm angle, the arm length L, and the rigidity K of the oscillation system of the conveying roller. If the arm angle θ is smaller than the value on the right side, which is calculated from the rigidity K of the oscillation system of the conveying roller and the arm length L, as shown in the following equation (4), it was discovered that self-oscillation of the conveying roller can be prevented.

$$\theta\leqq(Pse\times K^{-0.5})\times(1/L)$$

$$Pse=37500 \quad \text{Equation (4)}$$

where θ is $0°\leqq\theta\leqq90°$

Hereinafter, the present invention is described with reference to an embodiment applied to a copying machine as the image forming apparatus.

First of all, the configuration and operation of the copying machine according to the present embodiments are described.

Figure 6:
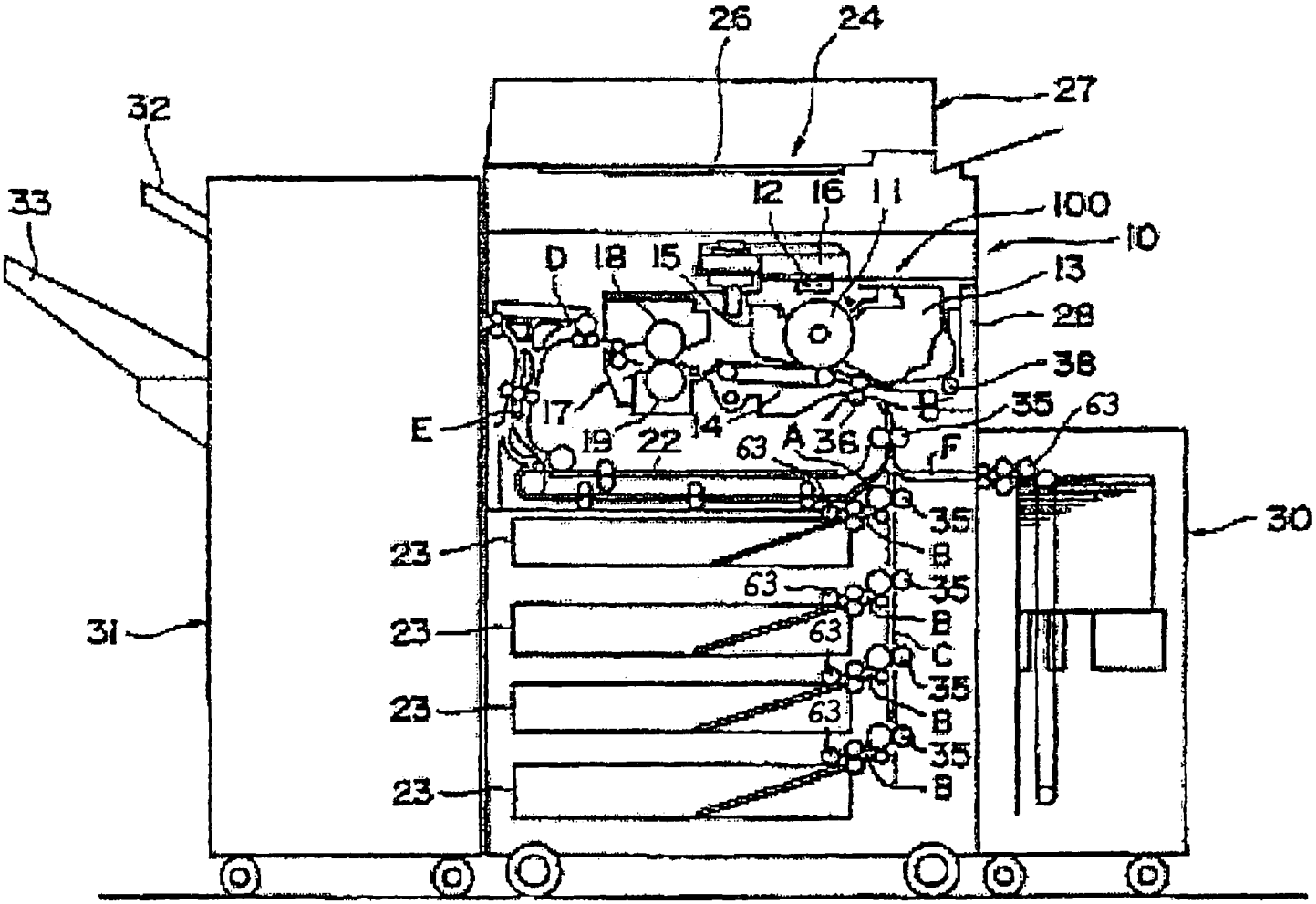
FIG. 6 is a figure showing a schematic configuration of a copying machine according to an embodiment of the present invention.

FIG. 6 shows a schematic configuration of the entire copying machine according to the present embodiments. An image forming section 100 is provided inside the copying machine main body 10, and this image forming section 100 comprises a drum-like photosensitive body 11 functioning as an image-supporting body. A charging device 12, a developing device 13, a transcript conveying device 14, a cleaning device 15, and the like are disposed around the photosensitive body 11. Furthermore, an upper section of the image forming apparatus 100 is provided with a laser writing device 16. This laser writing device 16 comprises unshown scanning optical systems such as a light source constituted by a laser diode and the like, a polygonal rotating mirror for scanning which is constituted from a polygon mirror, a polygon motor, a fθ lens, and a mirror. Moreover, a fixing device 17 is provided on the left side of the cleaning device 15 in the figure. The fixing device 17 comprises a fixing roller 18 having a heater therein, and a pressure roller 19 for pressing a recording sheet against the fixing roller 18 from beneath.

Further, a double-side unit 22 is provided blow the image forming section 100 inside the copying machine 10, and four paper feeding apparatuses 23, each of which is the sheet conveying apparatus, are provided further below. Each of the paper feeding apparatuses 23 stores recording sheets such as papers and OHP sheets. The recording sheets inside each of the paper feeding apparatuses 23 are conveyed to a common paper feed path C via a feed path shown with the symbol B in the figure, and then are sent to the transfer section positioned below the photosensitive body 11.

It should be noted that, when forming an image on the both sides of a recording sheet, the recording sheet inside the paper feeding apparatus 23 is sent to a transfer section to transfer an image on one side of the recording sheet, and then the image is fixed onto the recording sheet by the fixing device 17. Thereafter, the recording sheet is caused to pass through a reversing path E, which is divided from the middle of a discharge path D extending from the outlet of the fixing device 17 to a sheet post-processing device 31, and then is sent to the double-side unit 22. The recording sheet which is sent to the double-side unit 22 is again sent to the transfer section positioned below the photosensitive body 11 through a paper re-feed path A, and an image is transferred to the other side of the recording sheet.

An image reading section 24 and a contact glass 26 are provided above the image forming section 100 of the copying machine main body 10. Further, an automatic draft conveying apparatus (ADF) 27, which is the sheet conveying apparatus, is provided in an upper section of the contact glass 26 so as to cover the contact glass 26. The automatic draft conveying apparatus (ADF) 27 is provided openably and closeably with respect to the contact glass 26. The automatic draft conveying apparatus (ADF) 27 is described in detail herein after.

Furthermore, a hand tray 28 for guiding a recording sheet placed manually by a user to the common paper feed path C is openably and closeably provided on a right side surface of the copying machine main body 10 in the figure.

A mass paper feeding apparatus 30, which is the sheet conveying apparatus, is attached to the right side of the copying machine main body 10. This mass paper feeding apparatus 30 can load a large number of recording sheets therein, and is configured so as to raise and lower the large number of loaded recording sheets. The mass paper feeding apparatus 30 is described in detail herein after.

The sheet post-processing device 31 described above is attached to the left side of the copying machine main body 10 in the figure. This sheet post-processing device 31 receives a recording sheet to be discharged through the discharge path D, and discharges the recording sheet onto an upper catch tray 32 directly, or discharges onto the upper catch tray 32 or a lower catch tray 33 after performing post-processing such as stapling, punching, and the like.

When making a copy using the copying machine in the present embodiments, the user sets a draft on the automatic draft conveying apparatus 27, or opens the automatic draft conveying apparatus 27 and directly sets a draft on the contact glass 26. When a start switch, which is not shown, is pressed, the automatic draft conveying apparatus 27 is driven, and the draft which is sent onto the contact glass 26 of the image reading section 24, or the draft which is set onto the contact glass 26 in advance is read by the image reading section 24. Further, when the user presses the start switch, the photosensitive body 11 of the image forming section 100 rotates clockwise. Then, the laser writing device 16 emits a laser beam to a surfaces of the photosensitive body which is charged evenly by the charging device 12, in accordance with the contents which are read by the image reading section 24. Accordingly, an electrostatic latent image is formed on the surface of the photosensitive body 11. A toner is adhered to this electrostatic latent image at a region (developing region) opposite to the developing device 13. Accordingly, the electrostatic latent image becomes a toner image, and this toner image is sent to the transfer section.

Moreover, in the case of forming an image on a recording sheet inside the paper feeding apparatus 23, when the user presses the start switch, the pickup roller 63 rotates, and the recording sheet is sent to a feed path B from a specified paper feeding apparatus 23 of the four paper feeding apparatuses 23. This recording sheet is conveyed to a register roller 36 by a conveying roller 35 through the paper feed path C. Then, the register roller 36 rotates so that the recording sheet enters the transfer section at the timing at which the front end of the toner image on the photosensitive body 11 reaches the transfer section, whereby the recording sheet is sent to the transfer section.

On the other hand, in the case of forming an image on a recording sheet inside the mass paper feeding apparatus 30, when the user presses the start switch, the pickup roller 63 rotates, and the recording sheet is sent to a conveying path F from the mass paper feeding apparatus 30. This recording sheet is conveyed to the register roller 36 by the conveying roller 35 through the paper feed path C. Thereafter, the same process is carried out to form an image on the recording sheet inside the paper feeding apparatus 23.

On the other hand, in the case of forming an image on the recording sheet placed manually on the hand tray 28, when the user presses the start switch, the paper feed roller 38 rotates, the recording sheet is sent to the paper feed path C from the hand tray 28, and conveyed to the register roller 36. Thereafter, the same process is carried out to form an image on the recording sheet inside the paper feeding apparatus 23.

The toner image, which is formed on the surface of the photosensitive body 11, is transferred by the transcript conveying device 14 to the recording sheet which is sent to the transfer section in the manner described above. The transferred remaining toner which remains on the surface of the photosensitive body 11 after the transfer is removed by the cleaning device 15. On the other hand, the transferred recording sheet is conveyed to the fixing device 17 by the transcript conveying device 14. Then, by applying heat and pressure by the fixing roller 18 and the pressure roller 19, the toner image is fixed onto the recording sheet. The recording sheet with the fixed toner image is sent to the sheet post-processing device 31 via the discharge path D, and eventually discharged to the catch trays 32, 33.

When forming an image on the both sides of the recording sheet, a toner image is fixed onto one side of the recording sheet as described above, thereafter this recording sheet is sent to the reversing path E from the middle of the discharge path D, and then sent from the double-sided unit 22 to the transfer section again through the paper re-feed path A. Then, the toner image is transferred and fixed onto the other side of the recording sheet and sent to the sheet post-processing device 31 through the discharge path D, in the same manner.

The copying machine of the present embodiments is a process cartridge in which the photosensitive body 11 is integrated with the transcript conveying device 14 and the cleaning device 15, and this process cartridge is configured so as to be detachable with respect to the copying machine main body 10. It should be noted that the process cartridge may integrally support the photosensitive body 11 and at least one of the charging device 21, developing device 13, transcript conveying device 14, cleaning device 15 and the like provided around the photosensitive body 11.

Next, the paper feeding apparatus 23 and the mass paper feeding apparatus 30 which are the sheet conveying apparatus are described.

The paper feeding apparatus 23 of the present embodiments comprises a sheet storage section and a FRR separation device which is separation means for separating the recording sheets loaded on the sheet storage section into pieces and sending the separated recording sheet.

First, the FRR separation device is described. The FRR separation device is separation means for separating the top recording sheet from a sheaf of recording sheets inside each of the paper feeding apparatus 23 and the mass paper feeding apparatus 30, and sending the separated recording paper.

Figure 7:
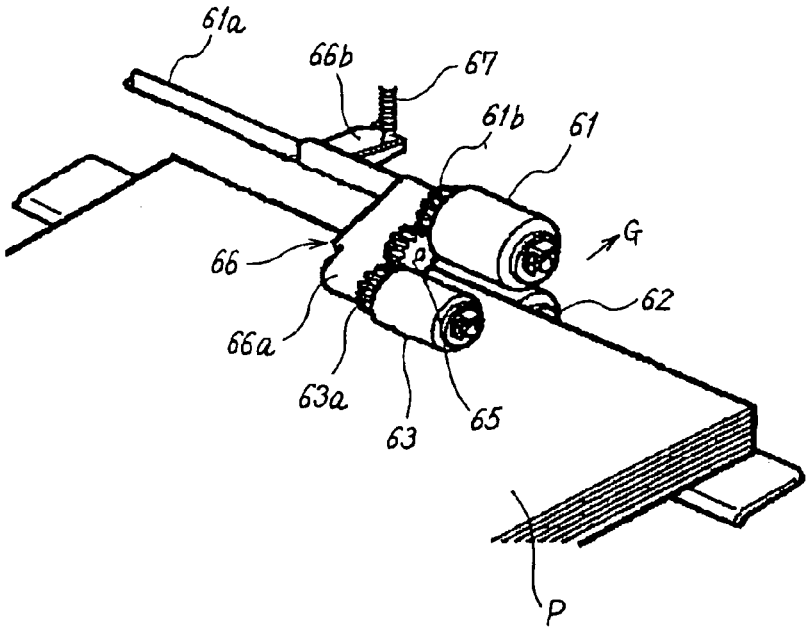
FIG. 7 is a perspective view showing a schematic configuration of a FRR separation device of the copying machine.

FIG. 7 shows a schematic configuration of the FRR separation device. As shown in the figure, this FRR separation device comprises the pickup roller 63 which contacts with the top recording sheet of a sheaf of recording sheets loaded inside each of the mass paper feeding apparatus 30 and the paper feeding apparatus 23, a feed roller 61 which separates the recording sheets conveyed from the pickup roller 63 into pieces and conveys the separated recording sheet, and a reverse roller 62. A rotation axis 61*a* of the feed roller 61 is connected to a drive motor which is not shown. An arm 66 is rotatably attached to the rotation axis 61*a* of the feed roller 61. The arm 66 is provided with a roller attachment section 66*a* and a spring attachment section 66*b*. An idler gear 65 and the pickup roller 63 are rotatably attached to the roller attachment section 66*a*. The idler gear 65 engages with a gear 61*b* provided on the feed roller 61 and a gear 63*a* provided on the pickup roller 63. Accordingly, rotary driving force of the drive motor is transmitted to the pickup roller 63 from the gear 61 provided on the feed roller 61 via the idler gear 65, whereby the pickup roller 63 rotates. A spring 67 is attached to the spring attachment section 66*b*, and the pickup roller 63 is brought into contact with a recording sheet elastically so that predetermined contact pressure is obtained. Moreover, a solenoid 69 (see FIG. 10 and FIG. 12) for separating the recording sheet from the pickup roller 63 is attached to the spring attachment section 66*b*. The solenoid 69 is driven at predetermined timing as described herein after, whereby the spring attachment section 66*b* is moved downward in the figures. Consequently, the arm 66 rotates in a right direction in the figure around the rotation axis 61*a* of the feed roller 61. As a result, the pickup roller 63 separates from the recording sheet.

Next, an operation of this FRR separation device for separating the top recording sheet from the sheaf of recording sheets and sending the separated recording sheet is described.

Figure 8:
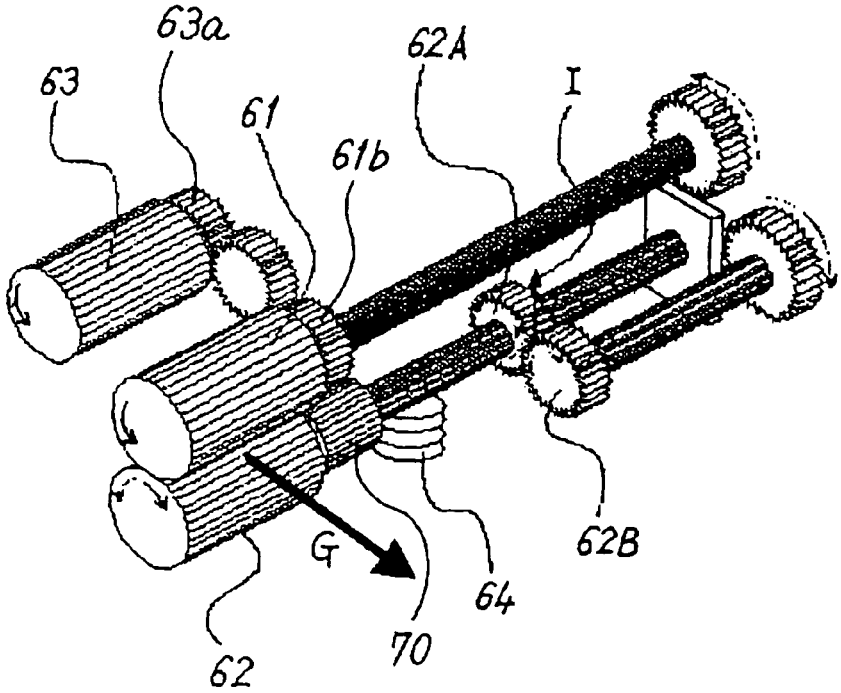
FIG. 8 is a figure for explaining a recording sheet separation operation performed by the FRR separation device.

First, a recording sheet separation operation performed by the FRR separation device is described with reference to FIG. 8.

The FRR separation device guides the top recording sheet of the recording sheets loaded inside each of the mass paper feeding apparatus 30 and the paper feeding apparatus 23 to the feed roller 61 by means of frictional fore of the pickup roller 63. Accordingly, the feed roller 61, which rotates in a direction of sending the recording sheet (normal direction) in a paper feed direction G, is applied with a predetermined torque by a torque limiter 70 in a direction opposite of the paper feed direction G. This torque is transmitted via a driven gear 62A, which is provided on an axis of the reverse roller 62 so as to engage with a driving gear 62B. Tooth surface pressure I and initial applied pressure between the driving gear 62B and the driven gear 62A are applied by the force of a spring 64 to the reverse roller 62 which is pressure-welded to the feed roller 61, whereby the reverse roller 62 is driven. Accordingly, the recording sheets inside the mass paper feeding apparatus 30 and the paper feeding apparatus 23 are separated and conveyed one by one.

Figure 9:
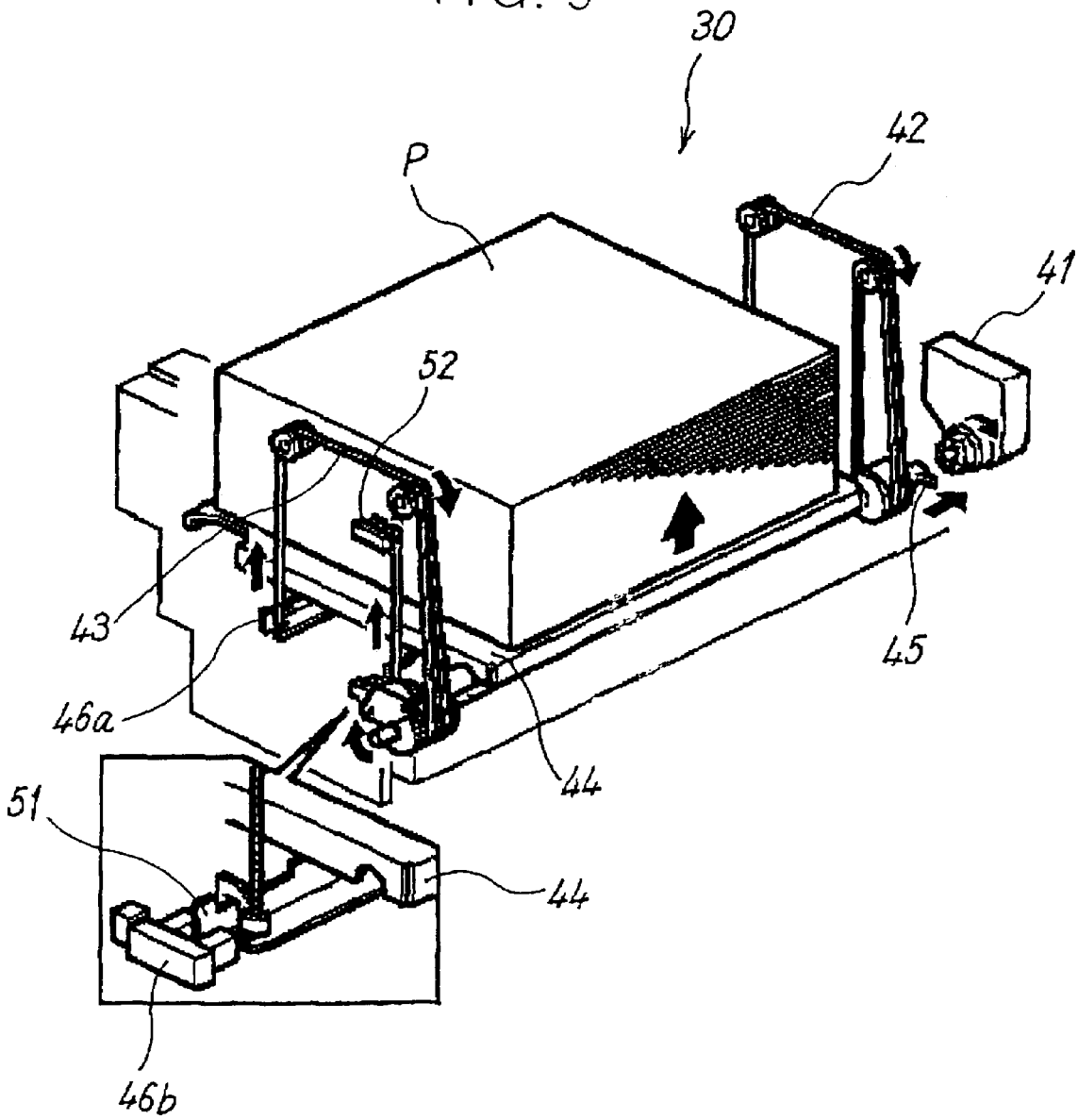
FIG. 9 is a perspective view showing a schematic configuration of a mass paper feeding apparatus of the copying machine.
Figure 10:
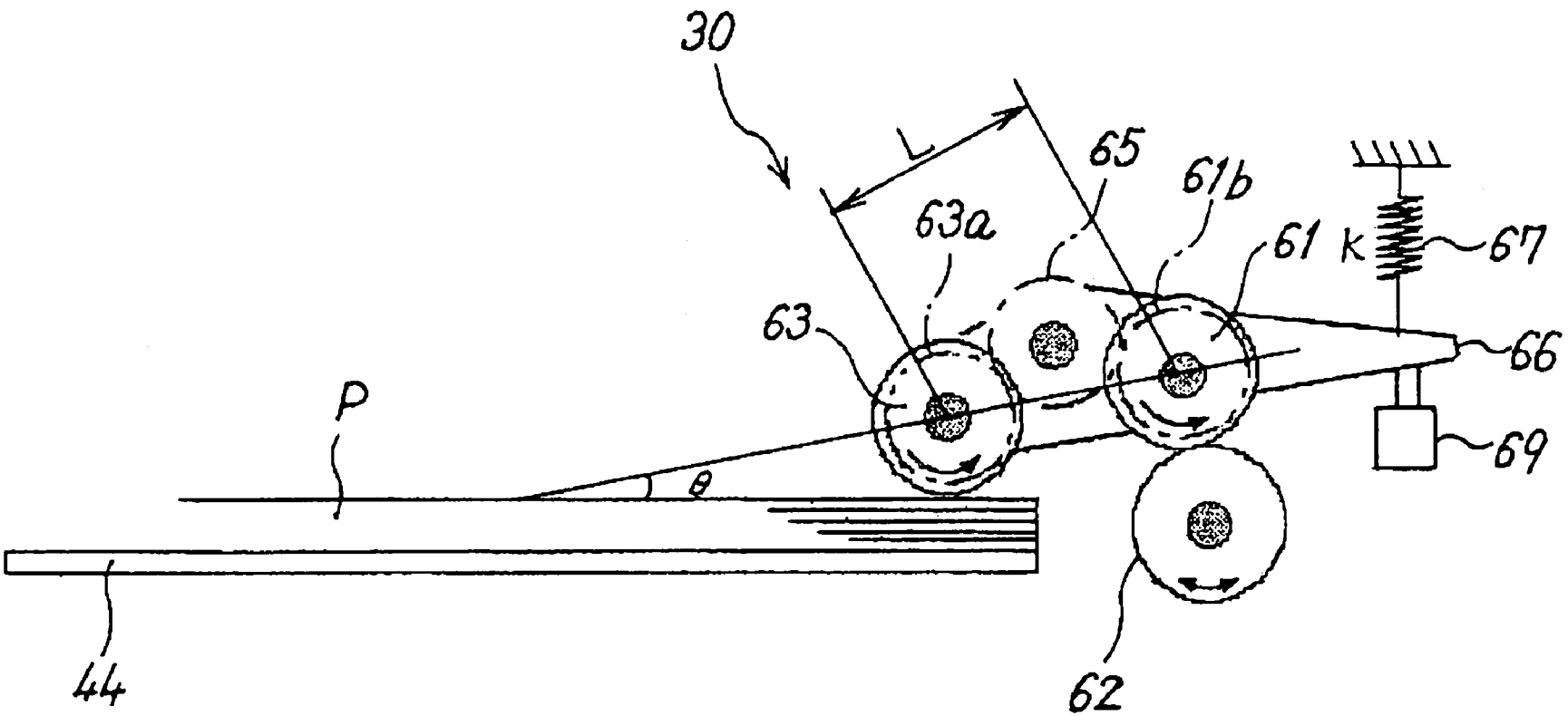
FIG. 10 is a cross-sectional view showing a schematic configuration of the mass paper feeding apparatus.

Next, the mass paper feeding apparatus 30 is described in detail with reference to FIG. 9 and FIG. 10.

As shown in the figures, the mass paper feeding apparatus 30 comprises a bottom plate 44 which is a sheet supporting member for loading a recording sheet inside the storage section, and stays 46*a*, 46*b* which are attached to the back of the bottom plate 44. One end of each of the wires 43, 42 is fixed to both ends of the stay 46*a*, 46*b*, and the other end of each of the wires 43, 42 is fixed to a rotation axis 45. The rotation axis 45 is connected to a bottom plate raising motor 41 which is sheet supporting member raising means. When the bottom plate raising roller 41 is driven, the rotation axis 45 rotates to wind round each of the wires 43, 42. Accordingly, the bottom plate 44 is raised, and the sheaf of recording sheets inside the mass paper feeding apparatus is pressure-welded to the pickup roller 63.

Figure 11:
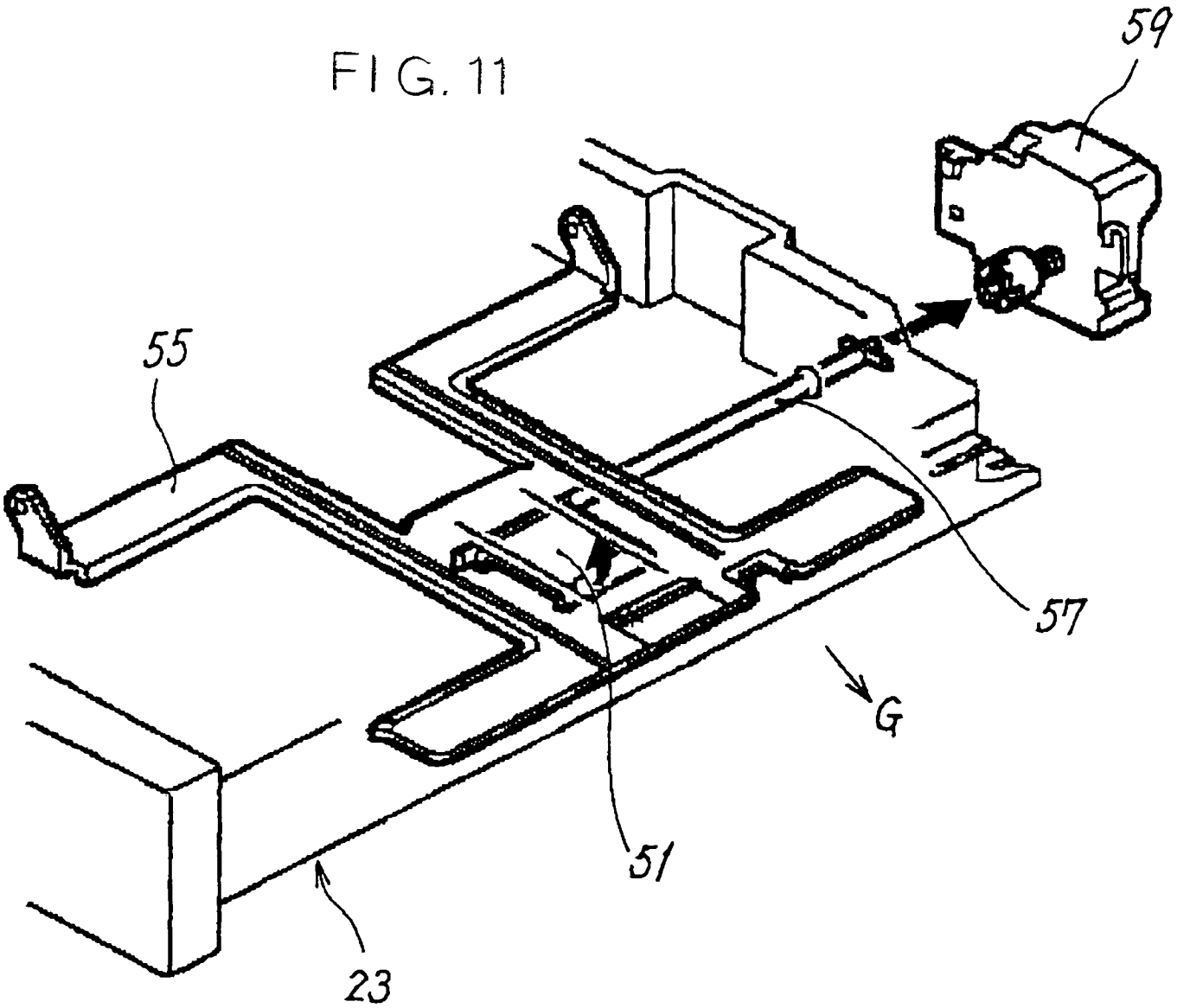
FIG. 11 is a perspective view showing a schematic configuration of a paper feeding apparatus of the copying machine.

Next, the paper feeding apparatus 23 is described in detail with reference to FIG. 11 and FIG. 12.

The paper feeding apparatus 23 comprises a bottom plate 55 which is a sheet supporting member. An end section of the bottom plate 55 which faces the pickup roller 63 is raised toward the pickup roller 63 by a lever 56 as shown in FIG. 12. The lever 56 is fixed to a lever axis 57, and the lever axis 57 is connected to a drive roller 59 which is the sheet supporting member raising means. When the drive roller 59 rotates by a predetermined angle, the lever axis 57 rotates and the lever 56 raises bottom plate 55 toward the pickup roller 63. Accordingly, the end section facing the pickup roller 63 is raised toward the pickup roller 63, whereby the recording sheet P on the bottom plate is pressure-welded to the pickup roller 63.

Figure 13:
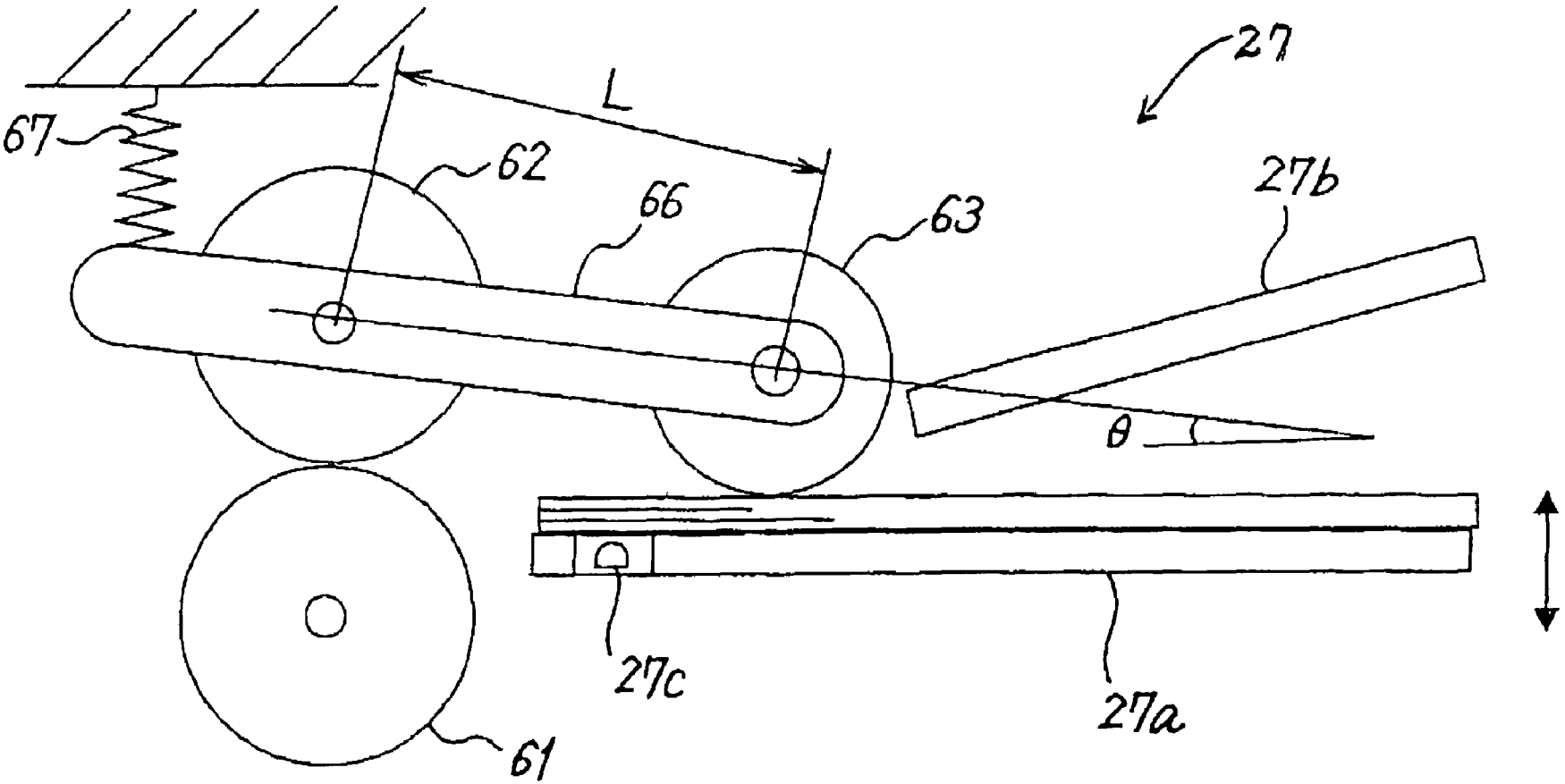
FIG. 13 is a figure showing a schematic configuration of an automatic draft conveying apparatus of the copying machine.

Next, the automatic draft conveying apparatus 27, which is the sheet conveying apparatus, is described in detail with reference to FIG. 13.

As shown in the figure, this automatic draft conveying apparatus 27 also comprises the abovementioned FRR separation apparatus. specifically, the automatic draft conveying apparatus 27 comprises the pickup roller 63 which contacts with the top draft sheet of a sheaf of draft sheets set on a set base 27*a* which is the sheet supporting member, the feed roller 61 which separates the draft sheets conveyed from the pickup roller 63 into pieces, and the reverse roller 62. The arm 66 is attached swingably to an axis of the feed roller 61, and the pickup roller 63 is rotatably attached to one end of the arm 66. The spring 67 is attached to the other end of the arm 66, and the pickup roller 63 is brought into contact with a recording sheet elastically so that predetermined contact pressure is obtained.

Furthermore, the automatic draft conveying apparatus 27 comprises an unshown drive motor for vertically moving the set board 27*a*. Moreover, a set sensor 27*c* for detecting whether a draft is set on the set board 27*a* or not is provided in the vicinity of an end portion of the set board 27*a* on the pickup roller side.

when a sheaf of draft sheets are set on the set board 27*a*, the set sensor 27*c* detects the drafts, the unshown drive motor is driven, and the draft sheets are brought into contact with the pickup roller 63 by a predetermined pressure. Here, when a start key of the apparatus is pressed, the top draft sheet of the sheaf of draft sheets is guided to the feed roller 61 by the frictional force of the pickup roller 63. Then, the feed roller 61 and the reverse roller 62 are rotated, and the draft sheets are separated into pieces, which is conveyed to the image reading section 24.

In the present embodiments, even when the number of sheets inside the mass paper feeding apparatus 30, paper feeding apparatus 23, and automatic draft conveying apparatus 27 is below twenty, the rigidity K of the oscillation system of the pickup roller, the length of the arm 66 L, and the arm angle θ of the arm are set so as to obtain the relationship shown in the above equation (4) so that the pickup roller 63 does not oscillate by itself. It should be noted that the arm angle θ is 0° when a line segment, which is obtained by connecting a sheet, a supporting point of the arm, and a section for attaching the pickup roller to the arm on an assumed plane perpendicular to the axis direction of the arm, is parallel to the sheet, and when the supporting point of the arm is positioned closer to an upstream side in the sheet conveyance direction than the axis attachment section of the conveying roller.

Next, self-oscillation of the pickup roller is described on the basis of FIG. 1.

As shown in FIG. 1, the center of axis of the pickup roller 163 moves while drawing a circular trail around the supporting 166*a* of the arm as shown in the line X-Y in the figure. Therefore, the upward or downward movement of the pickup roller 163 is in a direction perpendicular to a direction of the line segment connecting the supporting point 166*a* of the arm and the center of axis of the conveying roller, as shown in the figure. When the pickup roller 163 conveys a sheet, frictional force μN acts in a direction opposite of the sheet conveyance direction as shown in FIG. 1. When the frictional force μN acts, force F, which tries to move the pickup roller 163 upward, is generated as shown in the figure. Such occurrence is described herein after.

Figure 14:
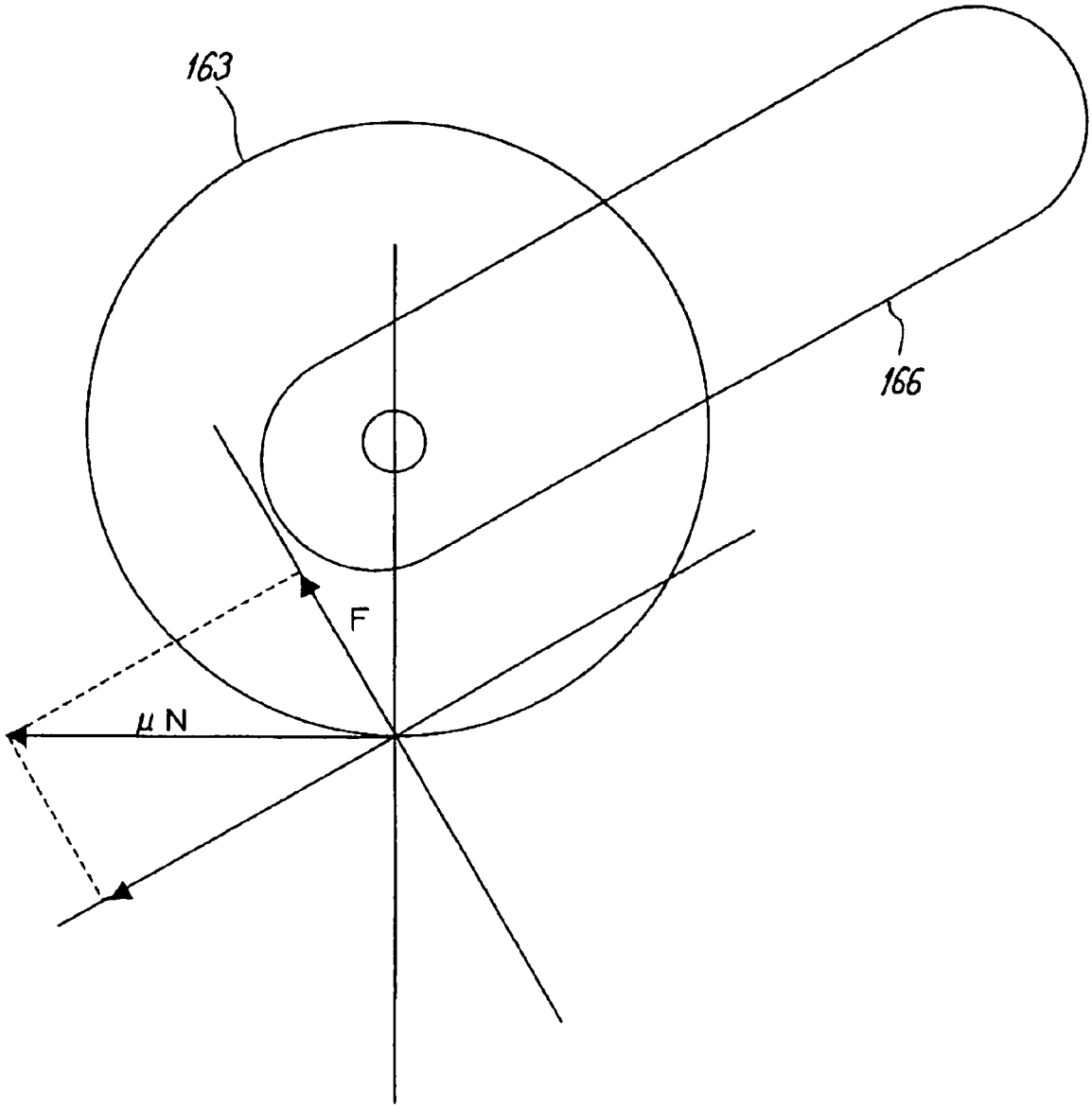
FIG. 14 is a figure showing force which is generated by frictional force and acts upward in a direction of movement of a pickup roller.

As shown in FIG. 14, the force F, which tries to move the pickup roller 163 upward, is a component of the frictional force μN in the direction (pickup roller movement direction) perpendicular to the direction of the line segment which connects the supporting point 166*a* of the arm to the center of axis of the pickup roller 163. The pickup roller 163 is pushed upward by the force F which tries to move the pickup roller 163 upward, the force F being generated by the frictional force μN. Consequently, the contact pressure between the pickup roller 163 and the sheet is reduced. As a result, the normal reaction N decreases, and the frictional force μN also decreases. Consequently, the force F pushing up the pickup roller 163 also decreases and the pickup roller 163 is moved to the sheet side. Inertia force is applied by the speed of movement at which the pickup roller 163 is moved to the sheet side, whereby the pickup roller 163 is brought into contact with the sheet by stronger force. In a case of a large number of sheets, the bunch of sheets deflects elastically and absorbs this inertia force, whereby the contact pressure between the sheets and the pickup roller 163 is prevented from increasing.

However, if the number of sheets is twenty or less, the elasticity decreases and the inertia force cannot be absorbed, thus the contact pressure between the sheet and the pickup roller 163 increases. Accordingly, the normal reaction N increases, whereby the frictional force μN and the force F increase, and the pickup roller 163 is pushed upward even more. When the pickup roller 163 is pushed upward, the normal reaction N decreases in the same manner as described above, whereby the force F decreases and the pickup roller 163 is moved to the sheet side. At this moment, since the pickup roller 163 is further pushed upward by the force F, the pickup roller 163 is moved to the sheet at higher speed. As a result, the inertia force increases even more, whereby the pickup roller 163 is brought into contact with the sheet by higher contact pressure. Then the force F further increases, whereby the pickup roller 163 is further pushed upward. Consequently, the inertia force further increases, and the pickup roller 163 is brought into contact with the sheet by yet stronger pressure.

Thereafter, the above-described operation, i.e., increase of the contact pressure→increase of the force for pushing up the pickup roller 163→increase of the inertia force→increase of the contact pressure, is repeated. As a result, oscillation of the pickup roller 163 grows, and the pickup roller 163 oscillates by itself.

To describe the principle of the self-oscillation of the pickup roller 163 with reference to FIG. 4, the result will be as follows. For example, suppose that there is a sheet conveying apparatus with an arm angle θ of 5° and an arm length of 50 [mm]. When this sheet conveying apparatus has a large number of sheets, it means that the sheets have sufficient elastic force and a low rigidity K of 20000 [N/m] of the oscillation system of the pickup roller. In this case, as shown in FIG. 4, below the borderline which indicates the occurrence of self-oscillation (the line segment connecting the plots of O in FIG. 4), there exists a point where the arm angle θ (5°) and inverse of the arm length L (0.02) intersects with each other. Therefore, when the sheet conveying apparatus has a large number of sheets, the relationship shown in the equation (4) is satisfied, and self-oscillation of the pickup roller does not occur. However, in the case of less number of a small number of sheets, the elasticity of the sheets inside the sheet conveying apparatus decreases, and the rigidity K of the oscillation system of the pickup roller increases. Consequently, the borderline indicating the occurrence of self-oscillation descends gradually. As a result, the point where the arm angle θ (5°) and the inverse of the arm length L (0.02) intersects with each other comes above the borderline indicating the occurrence of self-oscillation, whereby the relationship shown in the equation (4) is not satisfied. Therefore, in the case of a small number of sheets, self-oscillation of the pickup roller occurs.

Hence, the relationship among the arm angle θ, arm length L, and rigidity K of the oscillation system of the pickup roller 63 is set so that the relationship shown in the equation (4) is satisfied, when the sheet conveying apparatus has no sheets.

Figure 15:
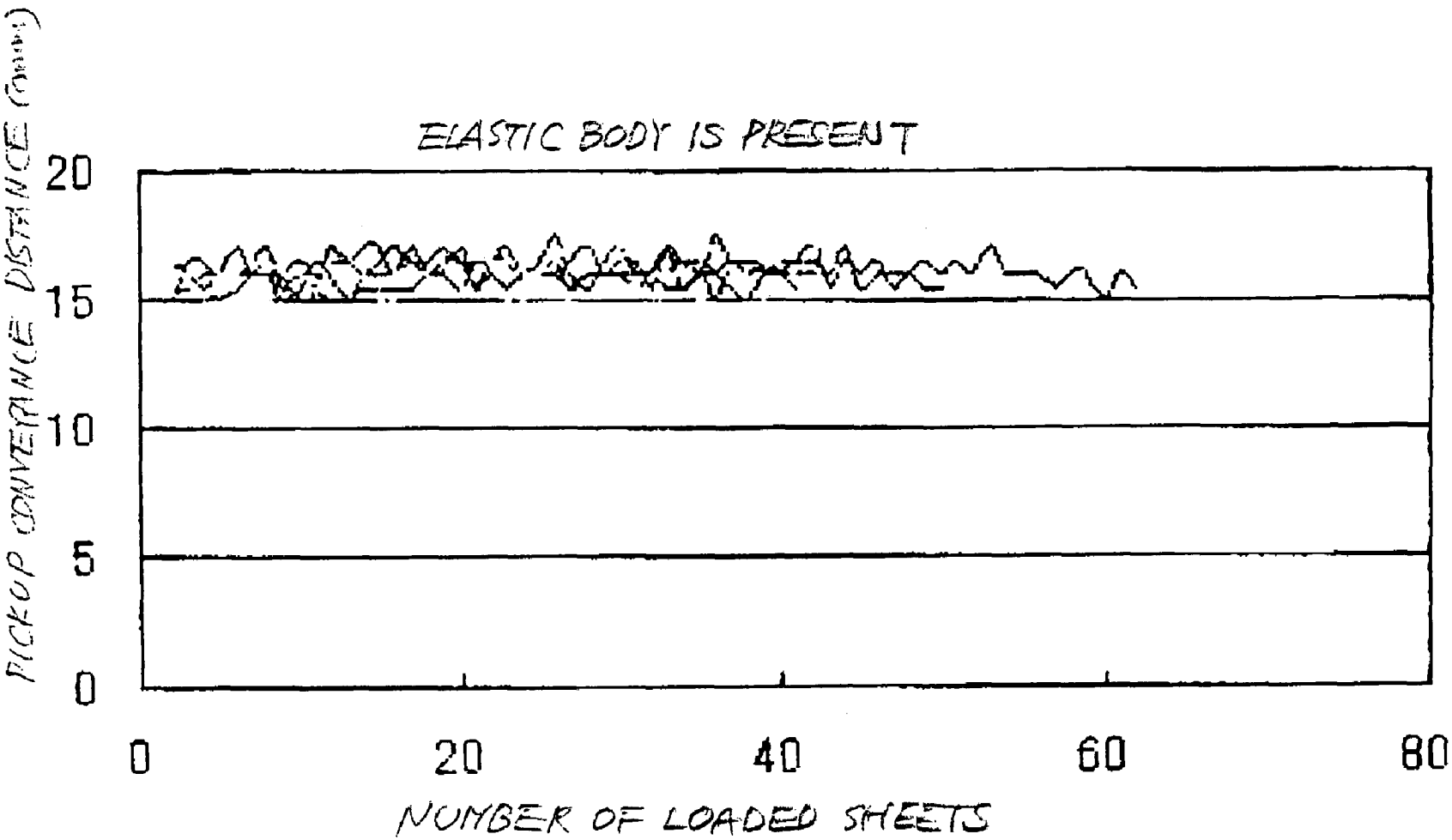
FIG. 15 is a graph showing the relationship between the number of loaded recording sheets inside a recording sheet storage section in the conventional sheet conveying apparatus of the present embodiments and a pickup conveyance distance.

FIG. 15 is a graph showing the relationship between the number of set sheets in the sheet conveying apparatus in which the arm angle θ, the arm length L, and the rigidity K of the oscillation system of the pickup roller 63 are set so that the relationship shown in the equation (4) is satisfied, and moving distance of the top sheet of the sheets which are set on the sheet conveying apparatus when the top sheet is conveyed by the pickup roller for a predetermined period of time. As is clear from this figure, even when the number of sheets is reduced, the pickup conveyance distance does not decrease. This is because the arm angle θ, the arm length L, and the rigidity K of the oscillation system of the pickup roller satisfy the relationship shown in the equation (4). Therefore, even when the number of sheets is reduced, the pickup roller 63 does not oscillate by itself. For this reason, even when the number of sheets inside the sheet conveying apparatus decreases, decrease in the pickup conveyance distance does not occur.

If two of the arm angle θ, the arm length L, and the rigidity K of the oscillation system of the pickup roller are determined, the rest is determined naturally. However, there is a case in which the arm angle θ and arm length L cannot be changed significantly due to limitations of the apparatus. therefore, generally, after determining the arm angle θ and the arm length L in advance, designing is performed so that the rigidity K of the oscillation system of the pickup roller satisfies the equation (4).

Moreover, as shown in FIG. 4, the smaller the arm angle θ, the harder it is for the pickup roller to oscillate by itself, providing free allowance in designing the rigidity K and the arm length L.

The reason thereof is as follows. As shown in FIG. 14, the force F which is generated by the frictional force μN and tries to push the pickup roller upward is obtained by decomposing the frictional force μN to the direction of the line segment connecting the supporting point 166*a* of the arm to the center of axis of the conveying roller, and to the direction of the line perpendicular to the above line (pickup roller movement direction). Therefore, if the arm angle θ increases, the movement of the pickup roller in the top-to-bottom direction gradually inclines to the counterclockwise movement. Consequently, the direction of the vertical movement of the pickup roller approaches the direction of the frictional force μN, thus, when decomposing the frictional force μN in the pickup roller movement direction, the force F acting in the direction of moving the pickup roller upward increases. As a result, the pickup roller easily moves upward and self-oscillation thereof occurs easily. On the other hand, the arm angle θ is reduced, the direction of moving the pickup roller upward and the direction of the frictional force μN separates from each other, whereby the force F for moving the pickup roller upward becomes small. As a result, the pickup roller cannot move upward easily, and self-oscillation thereof is prevented from occurring.

Further, as is clear from FIG. 4, the shorter the arm length L, the harder it is for the pickup roller to oscillate by itself, providing free allowance in designing the arm angle θ and the rigidity K of the oscillation system of the pickup roller.

This is because the distance between the center of axis of the pickup roller and the supporting point of the arm becomes short when the arm length L is reduced, thus larger force is required to move the pickup roller.

Further, as shown in FIG. 4, the lower the rigidity K of the oscillation system of the pickup roller, the harder it is for the pickup roller to oscillate by itself, providing free allowance in designing the arm angle θ and the arm length L. By reducing the rigidity K of the oscillation system of the pickup roller, the member constituting the oscillation system of the pickup roller deflects, whereby the oscillation of the pickup roller can be attenuated. As a result, it becomes hard for the pickup roller to oscillate by itself.

Reduction of the spring constant of the spring 67 functioning as conveying roller biasing means, for example, is considered as means for reducing the rigidity K of the oscillation system of the pickup roller. By reducing the spring constant of the spring 67, the rigidity K of the oscillation system of the pickup roller can be reduced. By reducing the spring constant of the spring 67, the oscillation of the pickup roller can be attenuated, and the occurrence of self-oscillation can be prevented. Moreover, the pickup roller 63 is formed by an elastic body such as rubber so that predetermined frictional force is obtained between the pickup roller 63 and a sheet. Therefore, the rigidity K of the oscillation system of the pickup roller can be reduced by reducing elastic coefficient of the pickup roller 63. By reducing the elastic coefficient of the pickup roller 63, the pickup roller 63 absorbs its oscillation, whereby self-oscillation is prevented. Furthermore, by configuring the arm 66 with an elastic body and reducing the rigidity of the arm, the rigidity K can be reduced. By configuring the arm 66 with an elastic body, the arm 66 is deformed to a curve, whereby self-oscillation of the pickup roller is prevented from occurring.

Figure 16:
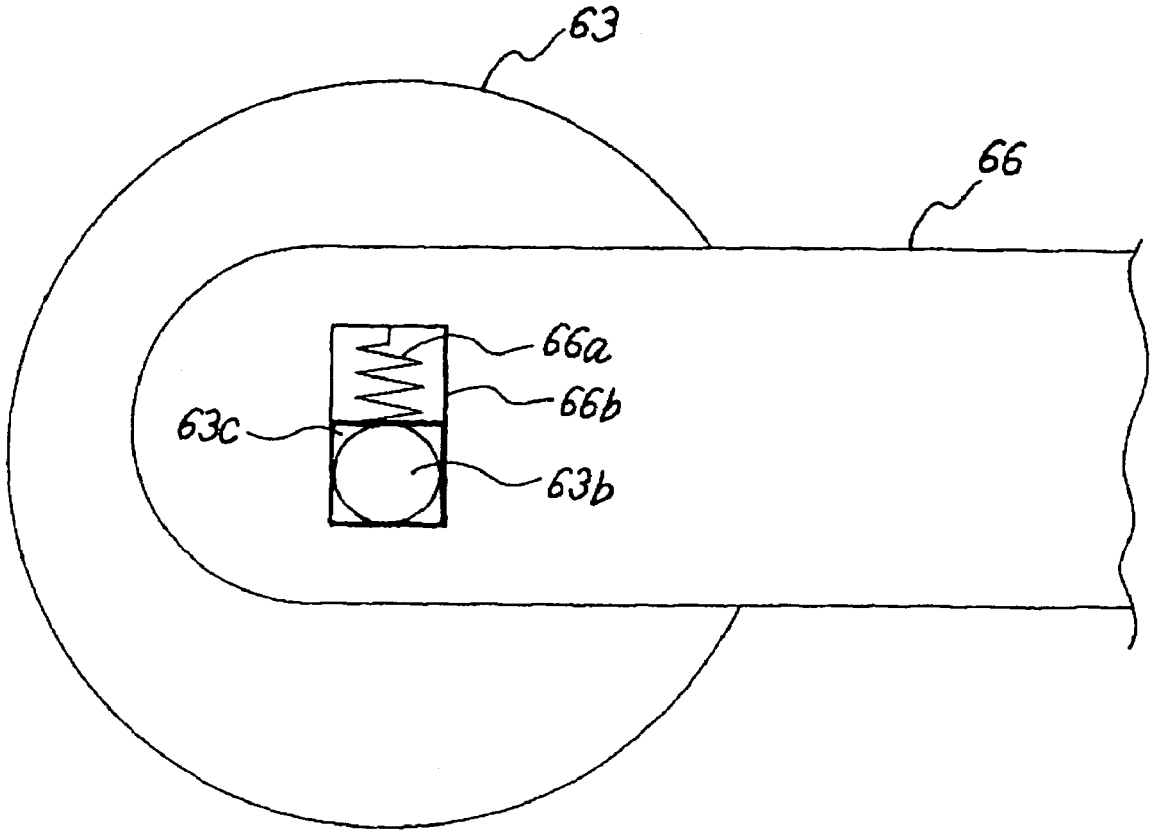
FIG. 16 is a figure showing an example in which the pickup roller is supported by an arm via an elastic member.

Moreover, as shown in FIG. 16, the pickup roller 63 may be supported by the arm 66 via an elastic member 66*a* such as rubber. In FIG. 16, the attachment section 66*b* of the arm 66 for the pickup roller 63 is taken as an elongate hole, and a bearing 63*c* of the pickup roller is attached to this elongate hole so as to be movable in a vertical direction. Then, the bearing 66*c* is biased downward in the figure by the elastic member 66*a*. In this manner, the rigidity K of the oscillation system of the pickup roller can be reduced by allowing the pickup roller 63 to be supported by the arm 66 via the elastic member 66*a* such as a spring.

Furthermore, the rigidity K of the oscillation system of the pickup roller may be reduced by providing an elastic body on the members such as the bottom plates 55, 44 functioning as the sheet supporting members and a pressure plate 27*d*, which are opposite to the pickup roller 63. Hereinafter, a configuration in which the rigidity K on the sheet supporting member side is reduced is described on the basis of the embodiments 1 through 3.

Figure 12:
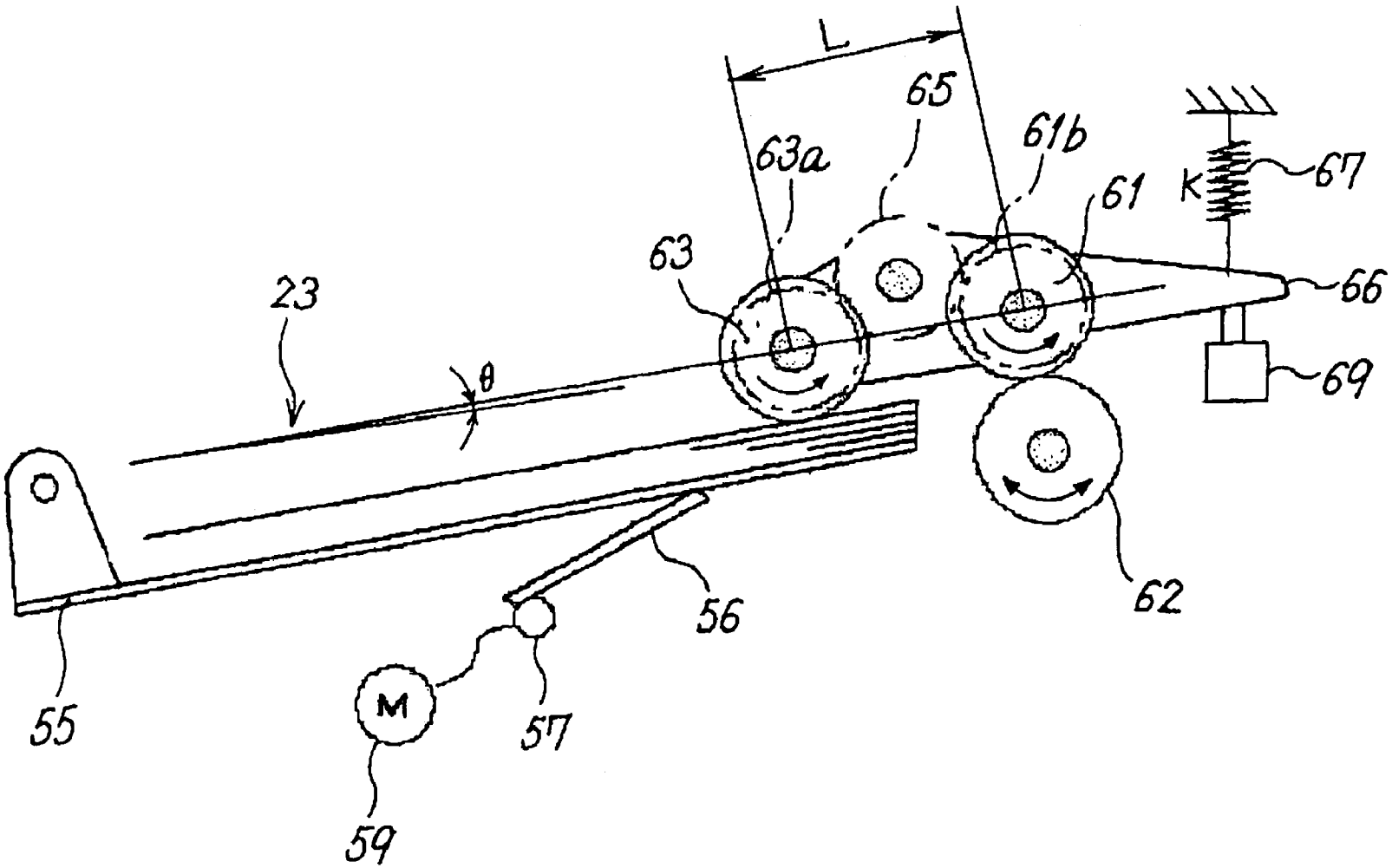
FIG. 12 is a perspective view showing a schematic configuration of the paper feeding apparatus.
Figure 17:
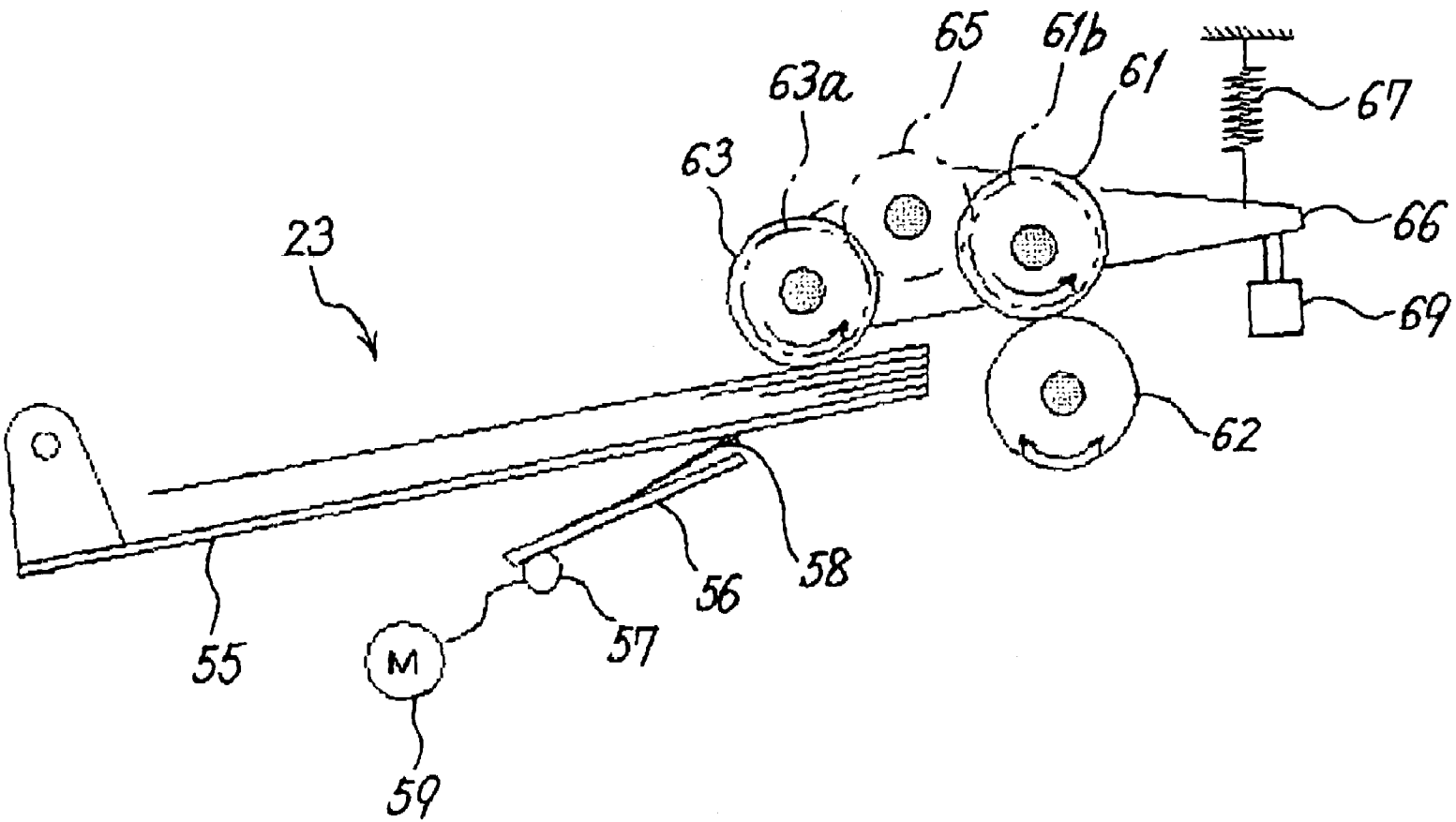
FIG. 17 is a figure showing a schematic configuration of the paper feeding apparatus of Example 1 of the present embodiments.

In the embodiment 1, the rigidity K of the oscillation system of the pickup roller is reduced by providing, as an elastic body, sheet supporting member biasing means for biasing, to the pickup roller side, the bottom plate 55 functioning as the sheet supporting member of the paper feeding apparatus 23 shown in FIG. 12. FIG. 17 is a figure showing the paper feeding apparatus of the embodiment 1. In the paper feeding apparatus of the embodiment 1, a plate spring 58 functioning as the sheet supporting member biasing means is provided between the bottom plate raising lever 56 and the bottom plate 55. When there are a large number of recording sheets stored in the paper feeding apparatus 23, the plate spring 58 may be completely compressed by the weight of the sheaf of the recording sheets and thus may not function. Since the rigidity K of the oscillation system of the pickup roller is reduced by the elasticity of the sheaf of recording sheets when there are a large number of recording sheets, the borderline where the pickup roller 63 oscillates by itself is raised as shown in FIG. 4.

When the number of recording sheets is reduced, the weight of the sheaf of recording sheets is also reduced, and the elastic force of the sheaf of recording sheets decreases. However, when the weight of the sheaf of recording sheets decreases, the plate spring 58 which was compressed by the sheaf of recording sheets gradually rises and then functions as a spring. As a result, even when the number of recording sheets is reduced and the elastic force of the sheaf of recording sheets is reduced, the elastic force of the plate spring 58 acts, whereby the rigidity K of the oscillation system can be prevented from being increased. As a result, the borderline where the roller oscillates by itself as shown in FIG. 4 is prevented from descending, and the relationship shown in the equation (4) is not satisfied. Accordingly, even when the number of recording sheets inside the paper feeding apparatus 23 decreases, the pickup roller does not oscillate by itself. Therefore, delay of conveyance of the recording sheets does not occur.

Figure 18:
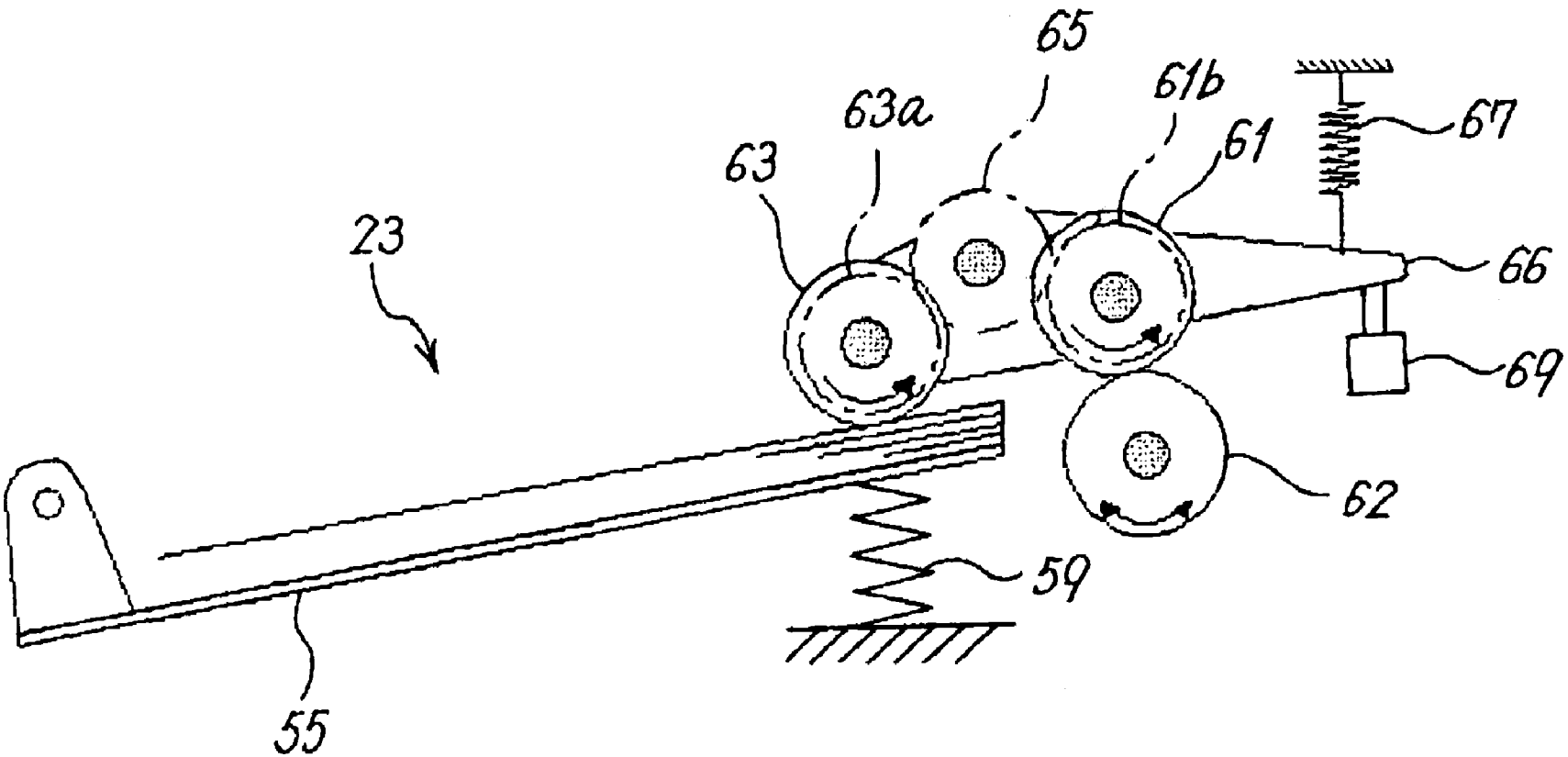
FIG. 18 is a figure showing a schematic configuration of a modified example of the paper feeding apparatus.

In the paper feeding apparatus 23, the plate spring 58, which is the sheet supporting member biasing means, and the drive motor 59, which is the sheet supporting member raising means, are provided separately. However, as shown in FIG. 18, the sheet supporting member raising means may be taken as a pressure roller 59 and used along with the sheet supporting member biasing means. In the example shown in FIG. 18, the pressure spring 59 raises the bottom plate 55 in accordance with the number of sheets on the bottom plate 55, and the pickup roller 63 is brought into contact with the sheets by a predetermined pressure. In this example shown in FIG. 18 as well, even when the elastic force of the sheaf of recording sheets is reduced, the elastic force of the pressure spring 59 acts, and the rigidity K of the oscillation system can be prevented from being increased.

Figure 19:
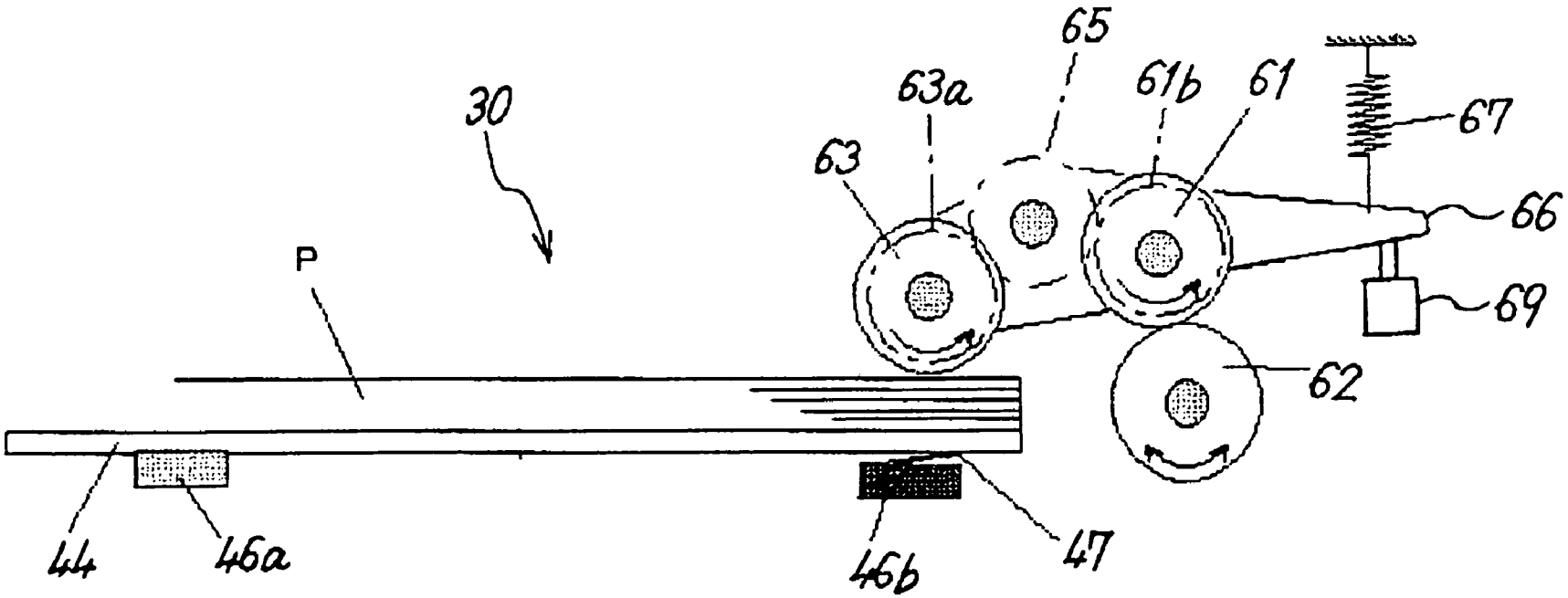
FIG. 19 is a figure showing a schematic configuration of the paper feeding apparatus of Example 2 of the present embodiments.

Next, the embodiment 2 is described. In the embodiment 2, the rigidity K of the oscillation system of the pickup roller is reduced by providing sheet supporting member biasing means for biasing, to the pickup roller side, the bottom plate 44 of the mass paper feeding apparatus 30 shown in FIG. 10. FIG. 19 shows the mass paper feeding apparatus 30 of the embodiment 2. In the mass paper feeding apparatus 30 of the embodiment 2, a plate spring 47 functioning as the sheet supporting member biasing means is provided between the bottom plate 44 and the stay 46*b*. In this manner, by providing the plate spring 47, the rigidity K of the oscillation system of the pickup roller can be reduced and, even when the number of recording sheets inside the mass paper feeding apparatus 30 is reduced, self-oscillation of the pickup roller 63 does not occur. Therefore, delay of conveyance of the recording sheets does not occur.

Next, the embodiment 3 is described. In the embodiment 3, a plate spring functioning as a supporting section elastic body is provided on the sheet side of the bottom plate. It should be noted that the following describes an example in which the supporting section elastic body is provided on the bottom plate 44 of the mass paper feeding apparatus 30, but this example can be implemented similarly in the bottom plate of the paper feeding apparatus 23 and the pressure plate 27*a* of the automatic draft conveying apparatus 27.

Figure 20:
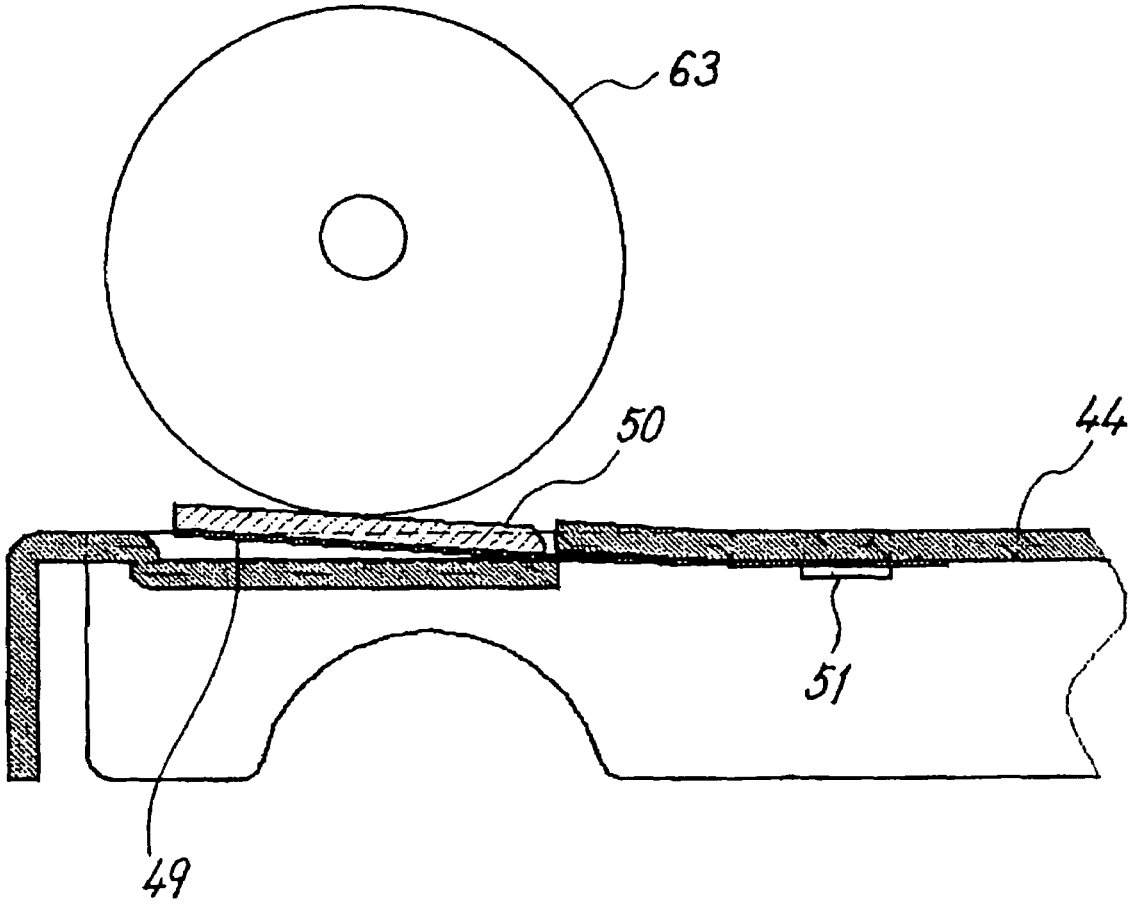
FIG. 20 is a figure showing a configuration of a substantial part of the paper feeding apparatus of Example 3 of the present embodiments.
Figure 21:
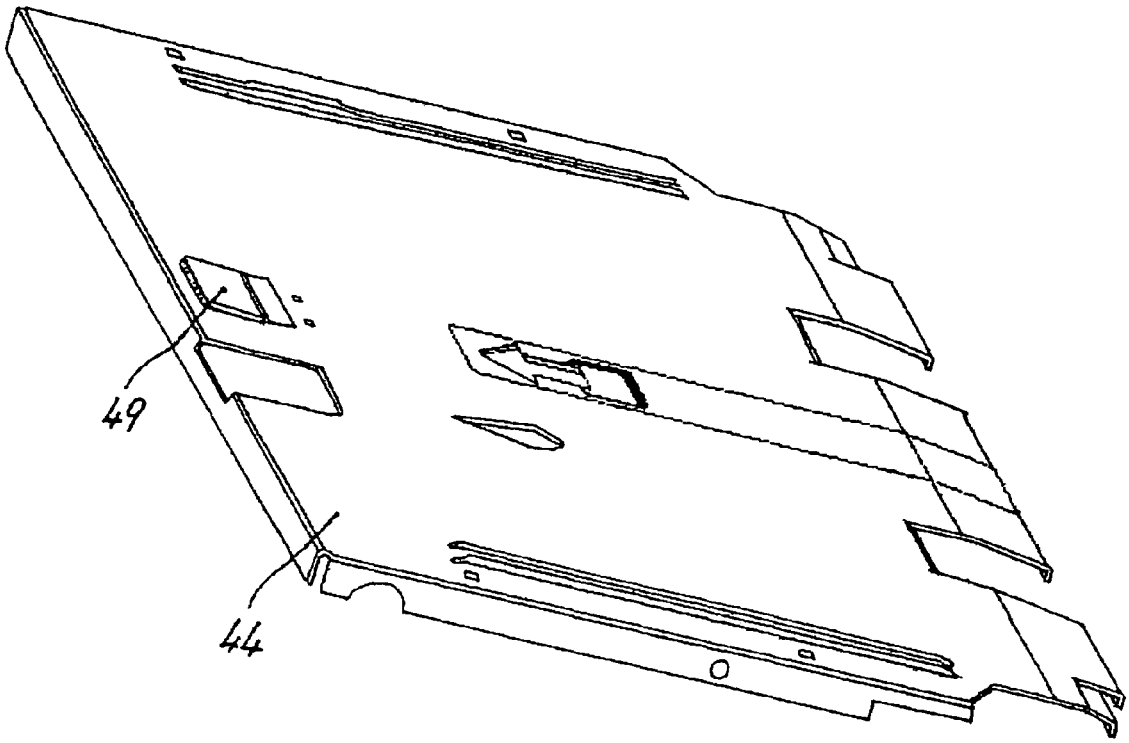
FIG. 21 is a perspective view showing a configuration of a bottom plate of this example.

As shown in FIG. 20, a plate spring 49, which is the supporting section elastic body, is provided in a position facing the pickup roller 63. A position on the bottom plate 44, which faces the pickup roller 63, is formed with a dent to form a space between the plate spring 49 and the bottom plate 44. A friction plate 50, which is a friction member, is attached to the upper surface of the plate spring 49. The frictional coefficient of the friction plate 50 is same as the frictional coefficient of the recording sheet. The frictional coefficient of the bottom plate 44 is lower than that of the recording sheet. Therefore, without the friction plate 50, when a recording sheet on the last recording sheet contacting with the bottom plate 44 is conveyed, the last recording sheets slips on the bottom plate 44 and conveyed along with the recording sheet overlapped on the last recording sheet, whereby a problem of multiple conveyance occurs. However, since the friction plate 50 is provided, when the recording sheet on the last recording sheet contacting with the bottom plate 44 is conveyed, the last recording sheet contacting with the bottom plate 44 is prevented from slipping on the bottom plate 44 by the frictional force of the friction plate 50. As a result, the last recording sheet is not conveyed along with the recording sheet overlapped on the last recording sheet, whereby the multiple conveyance can be prevented.

Figure 22:
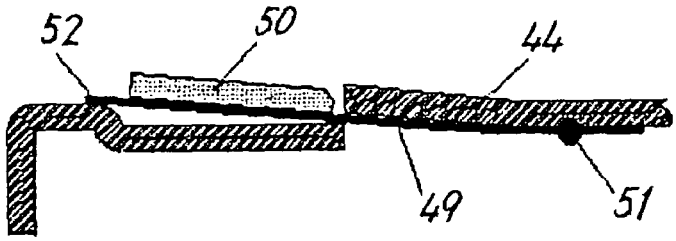
FIG. 22 is a figure showing a schematic configuration of a modification of Example 3.
Figure 23:
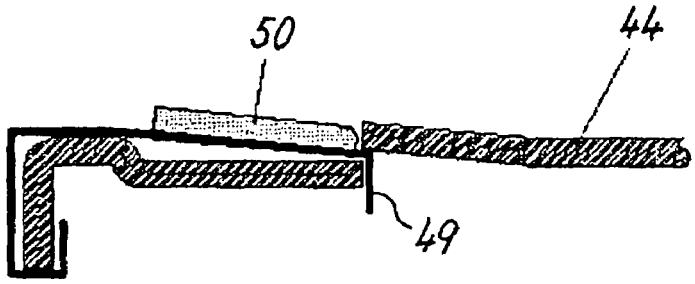
FIG. 23 is a figure showing a schematic configuration of other modification of Example 3.
Figure 24:
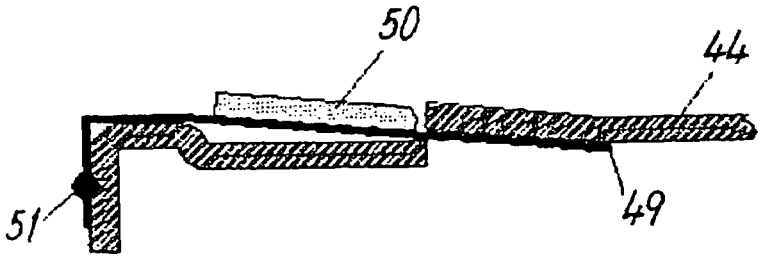
FIG. 24 is a figure showing a schematic configuration of yet other modification of Example 3.

In the example shown in FIG. 20, a plate spring 50 is fixed to the back of the bottom plate 44 by means of burring caulking 51. In this example, the plate spring 50 is cantilever-supported, but the present invention is not limited to this example. For example, as shown in FIGS. 22 through 24, the plate spring 49 may be supported at both ends. For the plate spring 50 shown in FIG. 22, one end thereof is fixed to the bottom plate 44 and the other end is a free end supported by the bottom plate 44. In FIG. 23, the both ends of the plate spring 50 are free ends. In FIG. 24, one end of the plate spring 50 is fixed to a side surface of the bottom plate 44 and the other end is a free end. In the examples shown in FIGS. 22 through 24, the section to which the friction plate 50 is attached is concaved toward the bottom plate 44, thereby functioning as a spring.

Examples of the material of the plate spring 49 include a SUS material, PET film, and the like, but the SUS material, which is metal, is preferred. By using the SUS material or other metal for the plate spring 50, excellent durability can be obtained, and the elastic force which does not change over time can be maintained. As in the embodiments 1 and 2, in the embodiment 3 as well the rigidity K of the oscillation system of the pickup roller can be reduced and self-oscillation of the pickup roller 63 can be prevented from occurring.

It should be noted that the embodiment 3 describes the example in which the plate spring is used as the supporting section elastic body, but a configuration in which an elastic body such as rubber is applied onto the bottom plate 44 may be used.

Figure 25:
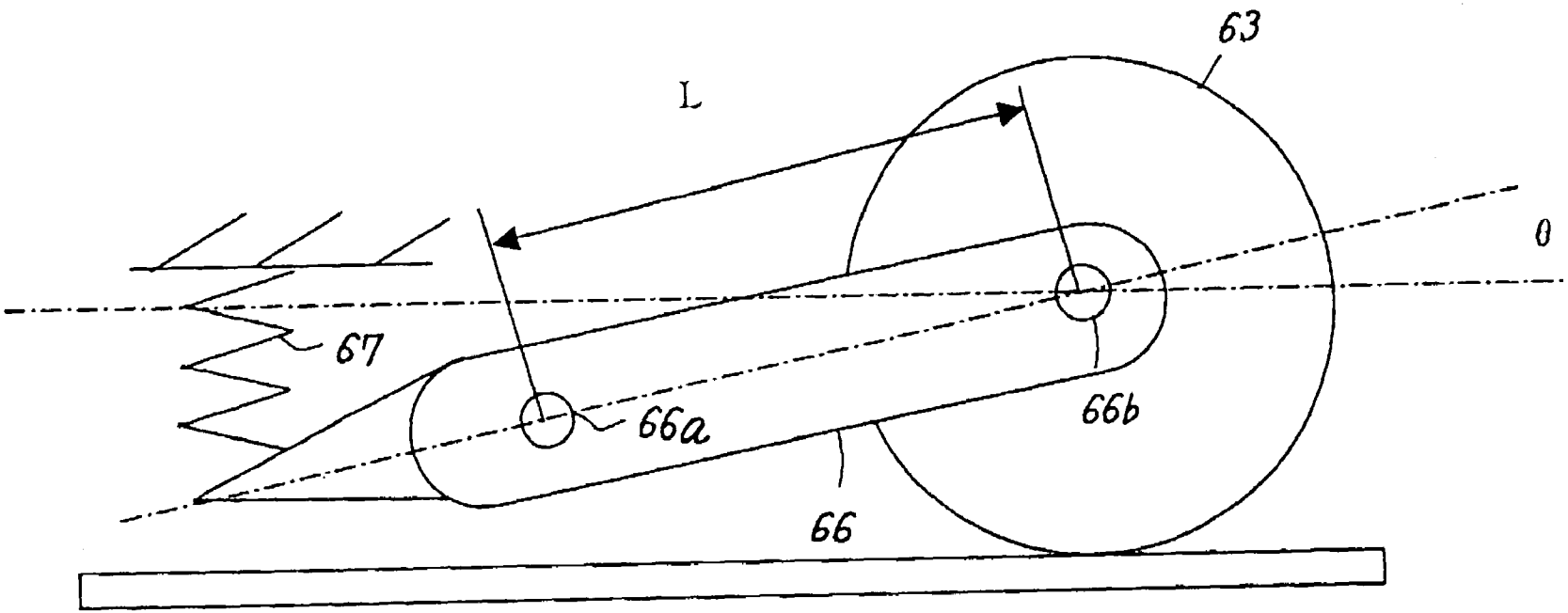
FIG. 25 is a figure showing a configuration of the sheet conveying apparatus constituted such that the supporting point of the arm is located closer to the sheet side than the center of axis of the pickup roller and the supporting point of the arm is located closer to an upstream side in a sheet conveyance direction than the center of axis of the pickup roller.

Furthermore, the above has described an example in which the arm angle θ, the rigidity K of the oscillation system of the pickup roller, and the arm length L are set using the equation (4) in the sheet conveying apparatus in which the center of axis of the pickup roller is located closer to the sheet side than the supporting point of the arm, and in which the supporting point of the arm is located closer to the downstream side in the sheet conveyance direction than the center of axis of the pickup roller. However, the present invention is not limited to this example. As shown in FIG. 25, in the sheet conveying apparatus in which the supporting point 66*a* of the arm 66 is located closer to the sheet side than the center of axis 66*b* of the pickup roller 63, and in which the supporting point 66*a* of the arm 66 is located closer to the upstream side in the sheet conveyance direction than the center of axis 66*b* of the pickup roller 63, the arm angle θ, the rigidity K of the oscillation system of the pickup roller, and the arm length L can be set using the equation (4), and self-oscillation can be prevented from occurring.

Figure 26:
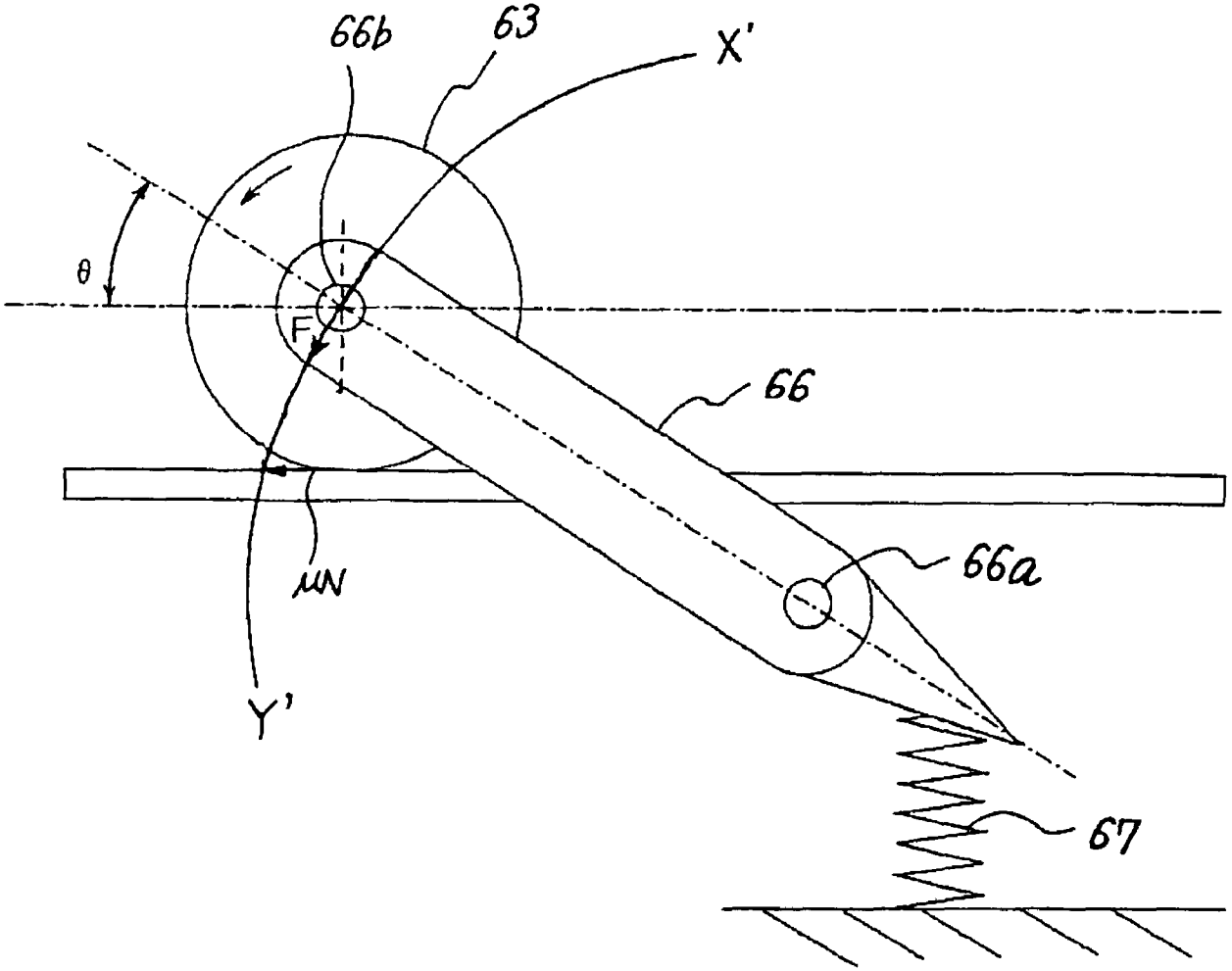
FIG. 26 is a figure showing a configuration of the sheet conveying apparatus constituted such that the center of axis of the pickup roller is located closer to the sheet side than the supporting point of the arm and the supporting point of the arm is located closer to a downstream side in the sheet conveyance direction than the center of axis of the pickup roller.
Figure 27:
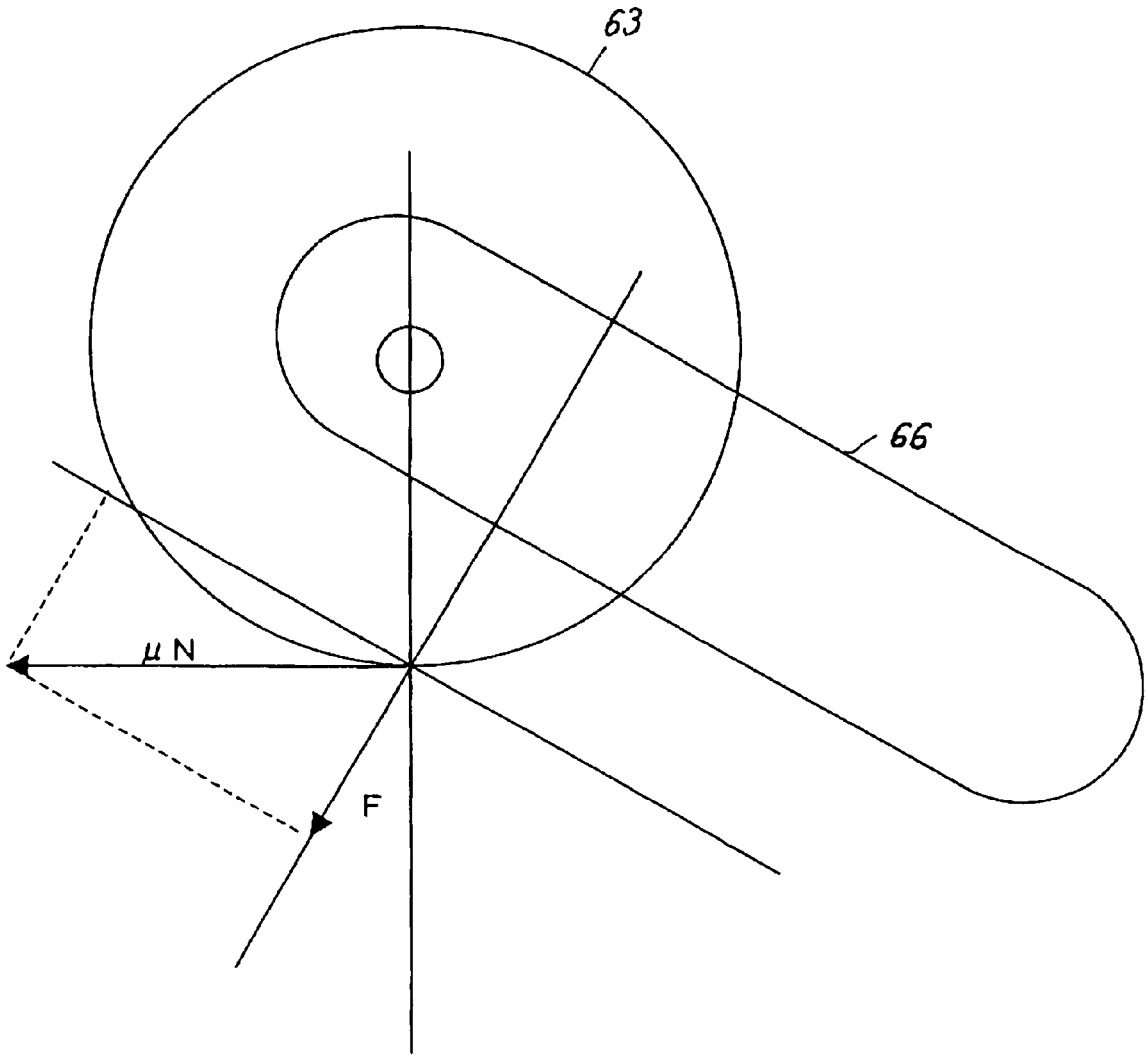
FIG. 27 is a figure showing force which is generated by the frictional force and acts downward in the direction of movement of the pickup roller.

Further, the sheet conveying apparatus shown in FIG. 26 is configured such that the center of axis 66*b* of the pickup roller 63 is located closer to the sheet side than the supporting point 66*a* of the arm 66, and that the supporting point 66*a* of the arm 66 is located closer to the downstream side in the sheet conveyance direction than the center of axis 66*b* of the pickup roller 63. By configuring the sheet conveying apparatus in this manner, self-oscillation of the pickup roller 63 can be prevented. This is because the force F acts in the direction in which the pickup roller moves downward. This force F is the frictional force μN, which acts in the direction (pickup roller movement direction) perpendicular to the direction of the line segment which connects the supporting point 66*a* of the arm to the center of axis of the pickup roller 63, as shown in FIG. 27. By configuring the sheet conveying apparatus in which the center of axis of the pickup roller 63 is located closer to the sheet side than the supporting point 66*a* of the arm, and in which the supporting point of the arm is located closer to the downstream side in the sheet conveyance direction than the center of axis of the pickup roller, the force F, which is generated by the frictional force μN, always acts in the direction of moving the pickup roller downward. Accordingly, since force which tries to push the pickup roller upward does not act, the pickup roller does not oscillate by itself.

Figure 28:
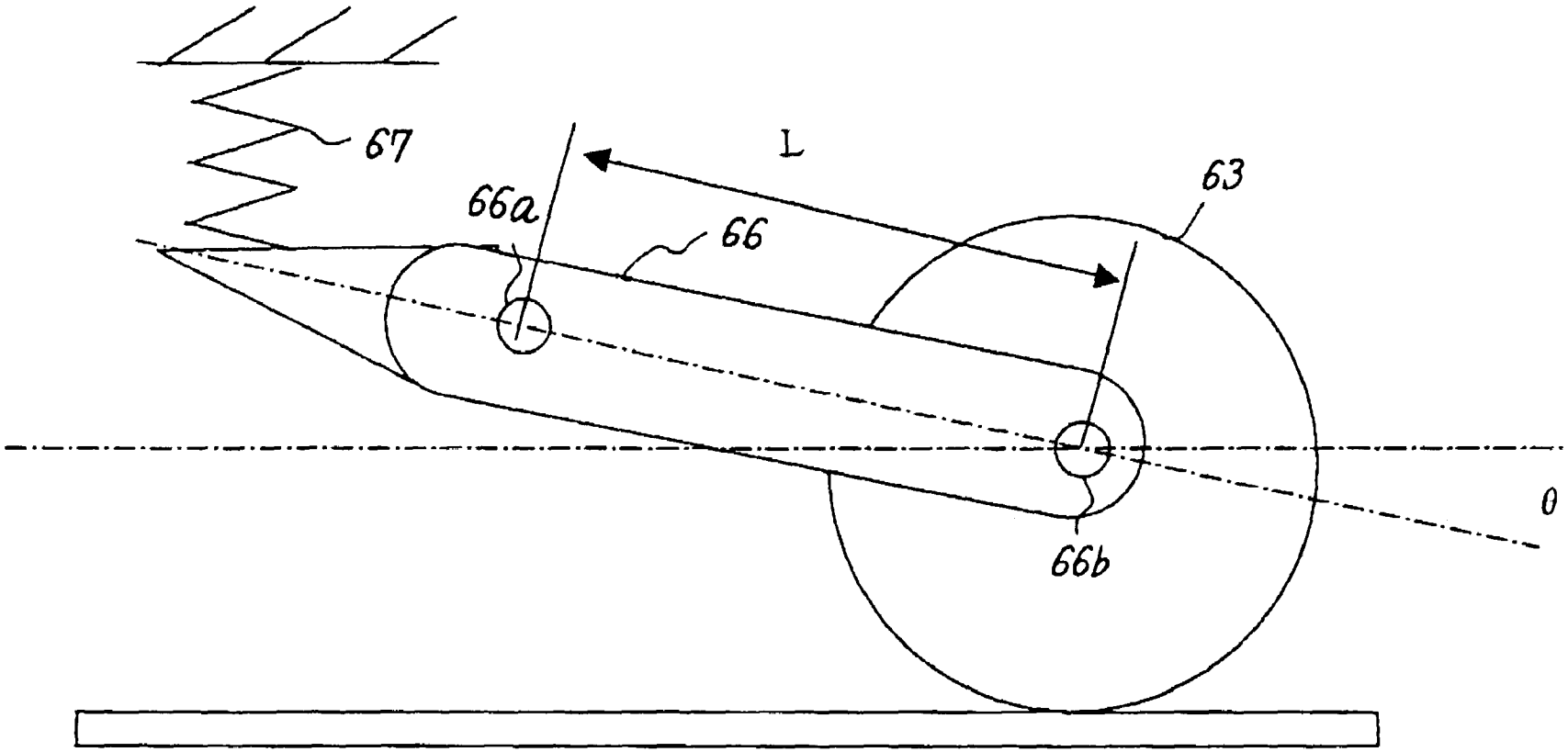
FIG. 28 is a figure showing the sheet conveying apparatus which is disposed such that the center of axis of the pickup roller is located closer to a sheet supporting member side than the supporting point of the arm and is also located closer to the downstream side in the sheet conveyance direction than the supporting point of the arm.

As shown in FIG. 28, the center of axis of the pickup roller may be disposed closer to the sheet supporting member side than the supporting point of the arm, and to the downstream in the sheet conveyance direction than the supporting point of the arm. Even in such arrangement, the force F, which is generated by the frictional force μN, acts in the direction of moving the pickup roller downward, thus the pickup roller 63 does not oscillate by itself.

The above has described the examples in which the present invention is applied to the paper feeding apparatus 23, the mass paper feeding apparatus 30, and the automatic draft conveying apparatus 27, but the present invention is not limited to these examples. For example, the present invention can be applied to an example in which a sheaf of recording sheets, which are set in the hand tray 28, are conveyed.

The sheet conveying apparatus of the present embodiments has the following characteristics.

(1) The sheet conveying apparatus is configured so that the arm angle θ, the rigidity K of the oscillation system of the pickup roller, and the arm length L are in the relationship shown in the equation (4). Accordingly, self-oscillation can be prevented in the sheet conveying apparatus in which the roller supporting section which supports the axis of the conveying roller of the arm is located closer to the sheet supporting member side than the supporting point of the arm, and the supporting point of the arm is located closer to the downstream side in the sheet conveyance direction than the conveying roller supporting section of the arm. Self-oscillation of the pickup roller 63, which is the conveying roller, can be prevented from oscillating by itself, and delay of sheet conveyance is also prevented.

(2) The sheet conveying apparatus is configured such that the supporting point of the arm is located closer to the sheet supporting member side than the roller supporting section of the arm, and that the supporting point of the arm is located closer to the upstream side in the sheet conveyance direction than the conveying roller supporting section of the arm, so that the arm angle θ, the rigidity K of the oscillation system of the pickup roller, and the arm length L are in the relationship shown in the equation (4). Accordingly, self-oscillation of the sheet conveying apparatus can be prevented. Self-oscillation of the pickup roller 63 which is a conveying roller can be prevented and delay of sheet conveyance can also be prevented.

(3) By configuring the sheet conveying apparatus by using a plurality of elastic bodies, the rigidity K of the oscillation system of the pickup roller can be lowered. Accordingly, even when the arm angle θ and the arm length L are determined in advance, the sheet conveying apparatus can be configured using the plurality of elastic bodies, and the rigidity K of the oscillation system of the pickup roller can be lowered, whereby the equation (4) can be satisfied. As a result, self-oscillation of the pickup roller can be prevented, and delay of sheet conveyance can also be prevented.

(4) By configuring the pickup roller, which is the conveying roller, by using the elastic bodies, the rigidity K of the oscillation system of the pickup roller can be lowered. Even when the arm angle θ and the arm length L are determined in advance, by changing the elastic coefficient of the pickup roller to obtain the rigidity K of the oscillation system of the pickup roller so that the relationship shown in the equation (4) is satisfied, self-oscillation of the pickup roller can be prevented, and delay of sheet conveyance can also be prevented.

(5) As one of the elastic bodies for configuring the sheet conveying apparatus, there is provided the spring 67, which is the conveying roller biasing means for biasing the pickup roller to the sheet supporting member (bottom plates 44, 45, or set board 27*a*) side. By changing the spring constant of this spring 67, the rigidity K of the oscillation system of the pickup roller can be changed. Therefore, even when the arm angle θ and the arm length L are determined in advance, by changing the spring constant of the spring 67 to obtain the rigidity K of the oscillation system of the pickup roller so that the relationship shown in the equation (4) is satisfied, self-oscillation of the pickup roller can be prevented, and delay of sheet conveyance can also be prevented.

(6) By configuring the arm 66 by using the elastic body, the rigidity K of the oscillation system of the pickup roller can be lowered. Even when the arm angle θ and the arm length L are determined in advance, by changing the rigidity of the arm 66 to obtain the rigidity K of the oscillation system of the pickup roller so that the relationship shown in the equation (4) is satisfied, self-oscillation of the pickup roller can be prevented, and delay of sheet conveyance can also be prevented.

(7) The elastic bodies configuring the sheet conveying apparatus may be provided on the sheet supporting member (bottom plates 44, 45, or set board 27*a*) side. Even if the elastic bodies are provided on the sheet supporting member side, the rigidity K of the oscillation system of the pickup roller 63 can be lowered.

(8) The supporting section elastic body may be provided on a position in the sheet supporting ember (bottom plates 44, 45 or set board 27*a*) which faces the pickup roller, to lower the rigidity K of the oscillation system of the pickup roller.

(9) The surface on the supporting section elastic body, which faces the pickup roller 63, is provided with a friction member in which the frictional coefficient against the sheet is lower than the frictional coefficient of the pickup roller 63 against the sheet and higher than the frictional coefficient of the sheet supporting member against the sheet. Accordingly, the frictional force between the pickup roller 63 and the sheet can be increased more, compared to the sheet supporting member which is not provided with the friction member. Therefore, the last sheet contacting with the sheet supporting member can be prevented from being conveyed along with the sheet on the last sheet, when the sheet on the last sheet is conveyed by the pickup roller. Moreover, since the frictional force of the friction member against the sheet is lower than the frictional force of the pickup roller against the sheet, the last sheet contacting with the sheet supporting member can be conveyed nicely by the frictional force between the pickup roller and the sheet.

(10) Since the frictional coefficient of the friction member against the sheet is equal to the frictional coefficient between the sheets, the state of conveying the last sheet contacting the sheet supporting member can be conformed to the state of conveying the sheet on the last sheet. Accordingly, even the last sheet can be conveyed equally with the sheet on the last sheet.

(11) The supporting section elastic body is formed as a plate, and a concave section is provided on the position of the sheet supporting member which faces the conveying roller, to form a space between the supporting section elastic body and the sheet supporting member. Accordingly, the plate-like member can be deflected toward the concave section of the sheet supporting member, and the plate-like member can be deformed elastically. As a result, the rigidity K of the oscillation system of the pickup roller can be lowered.

(12) By configuring the abovementioned plate-like member with metal, excellent durability can be obtained, and deflection which does not change over time can be maintained. As a result, elastic deformation can be performed over time, the rigidity K of the oscillation system of the pickup roller can be maintained over time, and self-oscillation of the pickup roller can be prevented over time.

(13) The both ends of the plate-like member are supported by the sheet supporting member, and at least one end section of the plate-like member can move to the sheet supporting member. Accordingly, the plate-like member can be deflected nicely toward the concave section of the supporting member. Furthermore, since the both ends of the plate-like member are supported by the sheet supporting member, it is possible to prevent a problem in which the plate-like member is caught when handling the sheet supporting member, causing an injury, or in which the plate-like member is broken.

(14) The plate-like member may be cantilever-supported by the holding member. By cantilever-supporting the plate-like member, the parts can be configured simply, compared to the case in which both ends of the plate-like member are supported, whereby the sheet conveying apparatus can be provided at low costs.

(15) As one of the elastic bodies configuring the sheet conveying apparatus, the sheet supporting member biasing means (plate springs 47, 58) for biasing the sheet supporting member to the pickup roller side is provided. Accordingly, the rigidity K of the oscillation system of the pickup roller can be lowered.

Furthermore, (16) as shown in FIG. 18, as the pressure spring, the sheet supporting member biasing means and the supporting member raising means may be used together. Accordingly, as shown in FIG. 17, compared to a case in which the sheet supporting member biasing means and the supporting member raising means are provided separately as the plate spring 59 and the drive motor 59 respectively, the sheet conveying apparatus can be provided at low costs.

(17) According to the sheet conveying apparatus of the present embodiments, the pickup roller 63 is supported by the arm 66 via the elastic body 66*a*, as shown in FIG. 16. By means of this elastic body 66*a*, the rigidity K of the oscillation system of the pickup roller can be lowered.

(18) According to the sheet conveying apparatus of the present embodiment, the relationship between the supporting point of the arm and the pickup roller supporting section is as shown in FIG. 26 and FIG. 28. Accordingly, the force generated from the frictional force acts in the lower side in the pickup roller movement direction, thus the pickup roller does not oscillate by itself.

(19) According to the paper feeding apparatus of the present embodiment, the sheet conveying apparatus having any of the above characteristics (1) through (18) is used. Accordingly, the pickup roller, which sends the recording sheets from the recording sheet storage section, can be prevented from oscillating by itself. Therefore, the recording sheets can be conveyed to the image forming section without delay. A problem can be avoided in which, because of late conveyance of recording sheets, a recording sheet is not conveyed to the transfer position at the timing at which the image on the photosensitive body is transferred to the recording sheet. Further, in the prior art, even when a recording sheet is conveyed late, there was a sufficient interval between the image formation processes so that the recording sheet is conveyed to the transfer position at the timing at which the image on the photosensitive body is transferred to the recording sheet. In the present embodiments, however, since delay of conveyance of the recording body is prevented, the recording sheet can be conveyed to the transfer position at the timing at which the image on the photosensitive body is transferred to the recording sheet, even when the interval between the image forming processes is narrowed, and the speed of image formation can be increased.

(20) According to the automatic draft conveying apparatus of the present embodiment, the sheet conveying apparatus comprising any of the above characteristics (1) through (18) is used. Accordingly, the roller, which conveys a draft sheet on the automatic draft conveying apparatus, can be prevented from oscillating by itself. As a result, delay of conveyance of the draft sheet can be prevented.

(21) The image forming apparatus of the present embodiment comprises at least one of the (19) paper feeding apparatus and (20) automatic draft conveying apparatus described above, thus the occurrence of delay of paper conveyance and the like can be prevented.

According to the present invention, if the relationship among the arm angle θ, the rigidity K of the oscillation system of the conveying roller, and the arm length L satisfies the relationship shown in the equation (4), self-oscillation can be prevented and whereby delay of sheet conveyance can be prevented.

Various modifications will become possible for those skilled in the art after receiving the teachings of the present disclosed without departing from the scope thereof.

What is claimed is:

1. A sheet conveying apparatus for conveying a sheet supported by a sheet supporting member, the sheet conveying apparatus comprising:

a conveying roller which contacts with the sheet supported by the sheet supporting member, at a predetermined pressure; and an arm which is disposed swingablly with one point as a supporting point, and rotatably supports an axis of the conveying roller at one end thereof, wherein a conveying roller supporting section, which supports the axis of the conveying roller of the arm, is located closer to the sheet supporting member side than the supporting point of the arm, and the supporting point of the arm is located closer to a downstream side in a sheet conveyance direction than the conveying roller supporting section of the arm, and, in a case in which rigidity of an oscillation system of the conveying roller is K [N/m], the distance between the supporting point of the arm and the roller supporting section of the arm is L [mm], and arm angle, which is formed between the sheet and a line segment connecting the supporting point of the arm to the roller supporting section of the arm on an assumed plane perpendicular to a direction of the axis of the conveying roller, is θ [deg], $\theta \leqq (Pse \times K^{-0.5}) \times (1/L)$ is satisfied, where Pse=37500.

2. The sheet conveying apparatus according to claim 1, wherein the oscillation system of the conveying roller is configured using a plurality of elastic bodies.

3. The sheet conveying apparatus according to claim 2, wherein one of the elastic bodies is a conveying roller.

4. The sheet conveying apparatus according to claim 2, further comprising conveying roller biasing means for biasing the conveying roller to the sheet supporting member side, wherein one of the elastic bodies is the conveying roller biasing means.

5. The sheet conveying apparatus according to claim 4, wherein one of the elastic bodies is an arm.

6. The sheet conveying apparatus according to claim 4, wherein one of the elastic bodies is placed on the sheet supporting member side.

7. The sheet conveying apparatus according to claim 6, wherein one of the elastic bodies is a supporting section elastic body provided on a position on the sheet supporting member, which faces the conveying roller.

8. The sheet conveying apparatus according to claim 7, further comprising a friction member provided on a surface of the supporting section elastic body, which faces the conveying roller, wherein the frictional coefficient of the friction member against the sheet is lower than the frictional coefficient of the conveying roller against the sheet and higher than the frictional coefficient of the sheet supporting member against the sheet.

9. The sheet conveying apparatus according to claim 8, wherein the frictional coefficient of the friction member against the sheet is equal to the frictional coefficient between sheets.

10. The sheet conveying apparatus according to claim 7, wherein the supporting section elastic body is formed as a plate, a concave section is provided on a position on the sheet supporting member, which faces the conveying roller, and a space is formed between the supporting section elastic body and the sheet supporting member.

11. The sheet conveying apparatus according to claim 10, wherein the supporting section elastic body is made from metal.

12. The sheet conveying apparatus according to claim 10, wherein both ends of the supporting section elastic body are supported by the sheet supporting member, and at least one of ends of the supporting section elastic body is movable with respect to the sheet supporting member.

13. The sheet conveying apparatus according to claim 10, wherein the supporting section elastic body is cantilever-supported by a holding member.

14. The sheet conveying apparatus according to claim 6, further comprising sheet supporting member biasing means for biasing the sheet supporting member to the conveying roller side, wherein one of the elastic bodies is the sheet supporting member biasing means.

15. The sheet conveying apparatus according to claim 14, wherein the sheet supporting member biasing means serves as sheet supporting member raising means for raising the sheet supporting member in accordance with the number of sheets loaded on the sheet supporting member, and bringing the sheaf of sheets into contact with the conveying roller at a predetermined pressure.

16. The sheet conveying apparatus according to claim 2, wherein the conveying roller is supported by the arm via an elastic body, and one of the elastic bodies is the elastic body.

17. A sheet conveying apparatus for conveying a sheet supported by a sheet supporting member, the sheet conveying apparatus comprising:

a conveying roller which contacts with the sheet supported by the sheet supporting member, at a predetermined pressure; and an arm which is disposed swingably with one point as a supporting point, and rotatably supports an axis of the conveying roller at one end thereof, wherein the supporting point of the arm is located closer to the sheet supporting member side than a conveying roller supporting section which supports the axis of the conveying roller, and the supporting point of the arm is located closer to an upstream side in a sheet conveyance direction than the conveying roller supporting section of the arm, and, in a case in which rigidity of an oscillation system of the conveying roller is K [N/m], the distance between the supporting point of the arm and the roller supporting section of the arm is L [mm], and arm angle, which is formed between the sheet and a line segment connecting the supporting point of the arm to the roller supporting section of the arm on an assumed plane perpendicular to a direction of the axis of the conveying roller, is θ [deg], $\theta \leqq (Pse \times K^{-0.5}) \times (1/L)$ is satisfied, where Pse=37500.

18. A sheet conveying apparatus for conveying a sheet supported by a sheet supporting member, the sheet conveying apparatus comprising:

a conveying roller which contacts with the sheet supported by the sheet supporting member, at a predetermined pressure; and an arm which is disposed swingably with one point as a supporting point, and rotatably supports an axis of the conveying roller at one end thereof, wherein the supporting point of the arm is located closer to the sheet supporting member side than a conveying roller supporting section which supports the axis of the conveying roller of the arm, and closer to a downstream side in a sheet conveyance direction than the conveying roller supporting section of the arm, or the conveying roller supporting section of the arm is located closer to the sheet supporting member side than the supporting point of the arm and closer to the downstream side in the sheet conveyance direction than the supporting point of the arm.

* * * * *